US009376287B2

(12) United States Patent
Asano et al.

(10) Patent No.: US 9,376,287 B2
(45) Date of Patent: Jun. 28, 2016

(54) SHEET CONVEYING DEVICE, IMAGE FORMING APPARATUS, SHEET THICKNESS DETECTION SYSTEM

(71) Applicants: Yoshihiro Asano, Kanagawa (JP); Minoru Takahashi, Kanagawa (JP); Takahisa Koike, Tokyo (JP)

(72) Inventors: Yoshihiro Asano, Kanagawa (JP); Minoru Takahashi, Kanagawa (JP); Takahisa Koike, Tokyo (JP)

(73) Assignee: RICOH COMPANY, LTD., Tokyo (JP)

( * ) Notice: Subject to any disclaimer, the term of this patent is extended or adjusted under 35 U.S.C. 154(b) by 120 days.

(21) Appl. No.: 13/687,216

(22) Filed: Nov. 28, 2012

(65) Prior Publication Data

US 2013/0134665 A1 May 30, 2013

(30) Foreign Application Priority Data

Nov. 30, 2011 (JP) ..... 2011-262967
Nov. 12, 2012 (JP) ..... 2012-248644

(51) Int. Cl.
*B65H 7/02* (2006.01)
*B65H 43/00* (2006.01)

(52) U.S. Cl.
CPC ..... *B65H 43/00* (2013.01); *B65H 2404/14* (2013.01); *B65H 2511/13* (2013.01); *B65H 2513/10* (2013.01); *B65H 2553/51* (2013.01); *B65H 2801/06* (2013.01)

(58) Field of Classification Search
CPC ..... B65H 2511/13; B65H 7/02; B65H 7/06; B65H 7/12
USPC ..... 271/265.01, 265.04, 262, 263, 270
See application file for complete search history.

(56) References Cited

U.S. PATENT DOCUMENTS

| | | | | |
|---|---|---|---|---|
| 2009/0037018 | A1* | 2/2009 | Saikawa et al. | 700/223 |
| 2011/0262151 | A1* | 10/2011 | Ise | 399/16 |
| 2012/0065931 | A1* | 3/2012 | Krucinski | 702/170 |
| 2012/0069411 | A1 | 3/2012 | Satoh et al. | |

FOREIGN PATENT DOCUMENTS

| | | |
|---|---|---|
| JP | 5-096813 | 4/1993 |
| JP | 2009-190876 | 8/2009 |
| JP | 2010-202347 | 9/2010 |
| JP | 2011-037585 | 2/2011 |

OTHER PUBLICATIONS

Marks' Standard Handbook for Mechanical Engineers, sections 3-10 and 3-20, 1987.*

* cited by examiner

*Primary Examiner* — Thomas Morrison
(74) *Attorney, Agent, or Firm* — Harness, Dickey & Pierce, P.L.C.

(57) ABSTRACT

A sheet conveying device includes a conveying roller provided on an inner side of a curved part of a conveying path of a sheet; a driving unit configured to rotate the conveying roller; a drive control unit configured to control a rotation speed of the conveying roller by the driving unit; a rotation speed detecting unit configured to detect the rotation speed of the conveying roller; a conveying unit configured to convey the sheet laid across the conveying roller and the conveying unit; a conveying speed detecting unit configured to detect a conveying speed of the sheet; and a sheet thickness detecting unit configured to detect a thickness of the sheet based on the conveying speed of the sheet detected by the conveying speed detecting unit and the rotation speed of the conveying roller detected by the rotation speed detecting unit.

13 Claims, 19 Drawing Sheets

SHEET CONVEYING DEVICE, IMAGE FORMING APPARATUS, SHEET THICKNESS DETECTION SYSTEM

BACKGROUND OF THE INVENTION

1. Field of the Invention

The present invention relates to a sheet conveying device, an image forming apparatus, and a sheet thickness detection system.

2. Description of the Related Art

Image forming apparatuses such as printers and copiers convey a sheet that is a recording medium and forms an image on the sheet surface. Such an image forming apparatus includes a technology for detecting a double feeding state where plural sheets stacked on top of each other are conveyed together, and a technology for detecting the thickness of the sheet when conveying the sheet for optimizing image forming conditions according to the sheet thickness.

In an electrophotographic image forming apparatus, by detecting the sheet thickness, for example, the transfer conditions and fixing conditions are optimized according to the sheet thickness, and therefore the image quality can be improved.

As a technology for detecting the sheet thickness, for example, patent document 1 proposes the following medium thickness detecting device. The medium thickness detecting device includes a driving member positioned in a conveying path of a medium for rotationally driving the medium; a contact rotating body positioned to face the driving member, which can contact the medium being conveyed and move in the thickness direction of the medium according to the thickness of the medium when contacting the medium; and a movement amount detecting unit for detecting the movement amount of the contact rotating body in the thickness direction. The medium thickness is detected based on the movement amount between when the contact rotating body is contacting the medium and when the contact rotating body is not contacting the medium. Thus, even within a short time period for detecting the thickness of the medium, the thickness of the medium can be detected with high precision.

Patent Document 1: Japanese Laid-Open Patent Publication No. 2011-37585

However, in the medium thickness detecting device of patent document 1, the contact rotating body, the mechanism by which the contact rotating body can be moved in the thickness direction of the medium, and the sensor for detecting the movement amount of the contact rotating body needs to be provided separately from the mechanism for conveying the medium. Therefore, the configuration may be complex.

SUMMARY OF THE INVENTION

The present invention provides a sheet conveying device, an image forming apparatus, and a sheet thickness detection system, in which one or more of the above-described disadvantages are eliminated.

A preferred embodiment of the present invention provides a sheet conveying device, an image forming apparatus, and a sheet thickness detection system, by which the thickness of a sheet can be detected with a simple configuration by using the sheet conveying mechanism.

According to an aspect of the present invention, there is provided a sheet conveying device including a conveying roller provided on an inner side of a curved part of a conveying path of a sheet; a driving unit configured to rotate the conveying roller; a drive control unit configured to control a rotation speed of the conveying roller by the driving unit; a rotation speed detecting unit configured to detect the rotation speed of the conveying roller; a conveying unit configured to convey the sheet laid across the conveying roller and the conveying unit; a conveying speed detecting unit configured to detect a conveying speed of the sheet; and a sheet thickness detecting unit configured to detect a thickness of the sheet based on the conveying speed of the sheet detected by the conveying speed detecting unit and the rotation speed of the conveying roller detected by the rotation speed detecting unit.

According to an aspect of the present invention, there is provided a sheet thickness detecting system including a sheet conveying device including a conveying roller provided on an inner side of a curved part of a conveying path of a sheet, a driving unit configured to rotate the conveying roller, a drive control unit configured to control a rotation speed of the conveying roller by the driving unit, a rotation speed detecting unit configured to detect the rotation speed of the conveying roller, a conveying unit configured to convey the sheet laid across the conveying roller and the conveying unit, and a conveying speed detecting unit configured to detect a conveying speed of the sheet, wherein the sheet thickness detecting system further includes a sheet thickness detecting unit configured to detect a thickness of the sheet based on the conveying speed of the sheet detected by the conveying speed detecting unit and the rotation speed of the conveying roller detected by the rotation speed detecting unit.

According to an aspect of the present invention, there is provided a non-transitory computer-readable recording medium storing a sheet thickness detecting program that causes a computer in a sheet thickness detecting system to function as a sheet thickness detecting unit, the sheet thickness detecting system including a conveying roller provided on an inner side of a curved part of a conveying path of a sheet, a driving unit configured to rotate the conveying roller, a drive control unit configured to control a rotation speed of the conveying roller by the driving unit, a rotation speed detecting unit configured to detect the rotation speed of the conveying roller, a conveying unit configured to convey the sheet laid across the conveying roller and the conveying unit, and a conveying speed detecting unit configured to detect a conveying speed of the sheet, wherein the sheet thickness detecting unit is configured to detect a thickness of the sheet based on the conveying speed of the sheet detected by the conveying speed detecting unit and the rotation speed of the conveying roller detected by the rotation speed detecting unit.

BRIEF DESCRIPTION OF THE DRAWINGS

Other objects, features and advantages of the present invention will become more apparent from the following detailed description when read in conjunction with the accompanying drawings, in which.

DETAILED DESCRIPTION OF THE PREFERRED EMBODIMENTS

A description is given, with reference to the accompanying drawings, of embodiments of the present invention.

First Embodiment

Configuration of Image Forming Apparatus

Figure 1:
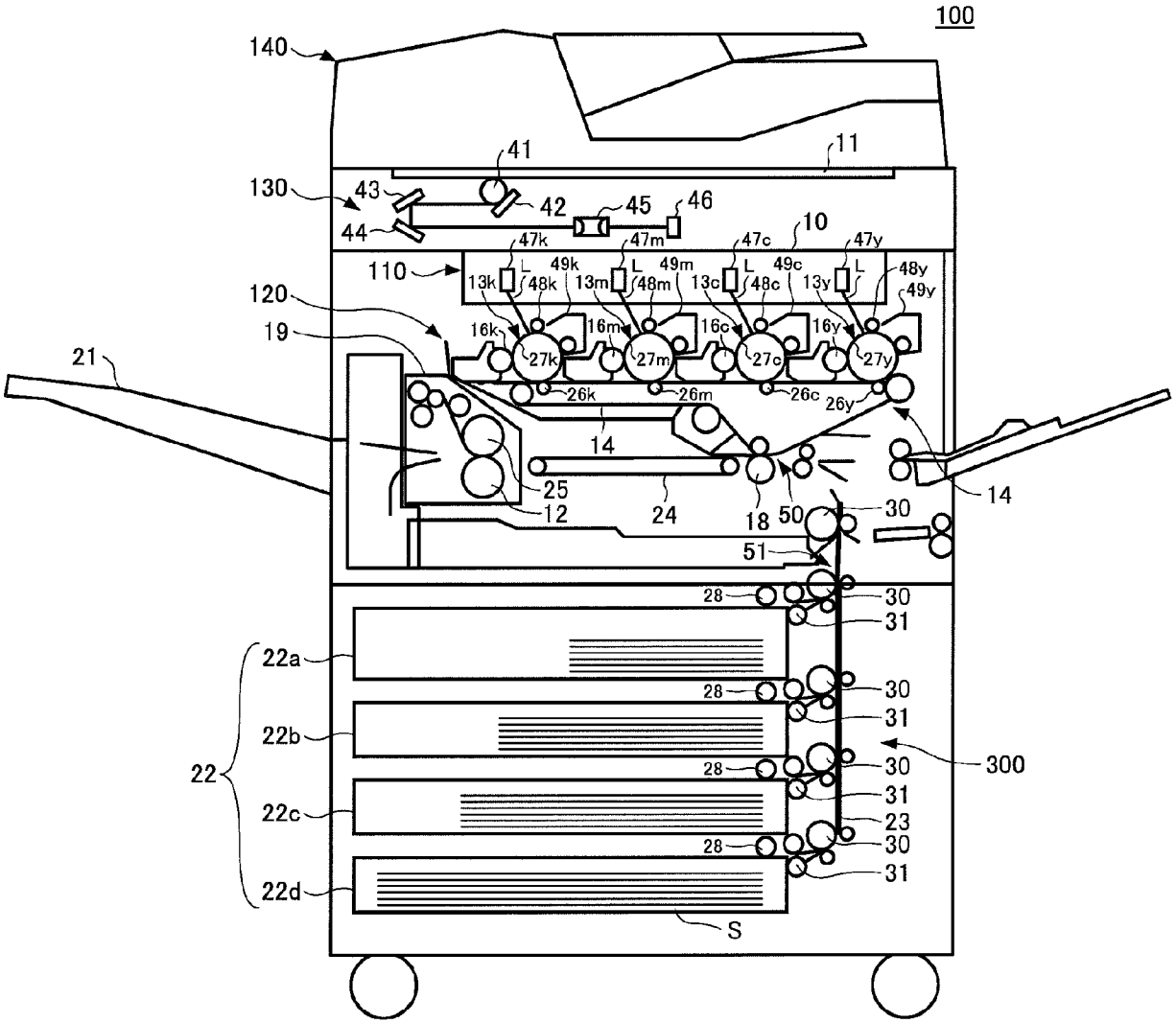
FIG. 1 illustrates a schematic configuration of an image forming apparatus according to a first embodiment.

FIG. 1 illustrates a schematic configuration of an image forming apparatus according to a first embodiment.

An image forming apparatus 100 includes an automatic document feeder (ADF) 140, an image scanning unit 130, a writing unit 110, an image forming unit 120, and a sheet conveying device 300.

The ADF 140 conveys an original document placed on a sheet feeding stand one by one onto a contact glass 11 of the image scanning unit 130, and ejects the original document onto a sheet eject tray after the image data of the original document has been scanned.

The image scanning unit 130 includes the contact glass 11 for placing an original document, and an optical scanning system. The optical scanning system includes a charging lamp 41, a first mirror 42, a second mirror 43, a third mirror 44, a lens 45, and a full-color CCD 46.

The charging lamp 41 and the first mirror 42 are provided in a first carriage, and the first carriage moves in a sub scanning direction at a fixed speed by a stepping motor when scanning an original document. The second mirror 43 and the third mirror 44 are provided in a second carriage, and the second carriage moves at half the speed of the first carriage by the stepping motor when scanning an original document. As described above, as the first carriage and second carriage move, the side of the original document with the image is optically scanned. The data obtained by scanning is focused on a light receiving surface of the full-color CCD 46 by lenses, and is subjected to photoelectric conversion.

The image data that has been photoelectrically converted into the respective colors of red (R), green (G), and blue (B) by the full-color CCD (or full-color line CCD) 46 is subjected to A/D conversion by an image processing circuit (not shown), and is then subjected to various image processing (γ correction, color conversion, image separation, gradation correction, etc.) by the image processing circuit.

Based on the image data that has undergone image processing, the writing unit 110 forms an electrostatic latent image on photoconductive drums 27 for each color. In the image forming apparatus 100, four photoconductive units 13 (13*y* for yellow, 13*m* for magenta, 13*c* for cyan, and 13*k* for black) are aligned in a conveying direction of an intermediate transfer belt 14.

Each of the photoconductive units 13 for the respective colors includes the photoconductive drum 27, a charging device 48 for charging the photoconductive drum 27, an exposing device 47 for exposing light to the charged photoconductive drum 27 and forming a latent image, a developing device 16 for turning the latent image into a visible toner image, and a cleaning device 49.

The exposing device 47 performs exposure by an LED writing method including a light-emitting diode (LED) array and a lens array positioned in an axial direction (main scanning direction) of the photoconductive drum 27, in the example of FIG. 1. The exposing device 47 forms an electrostatic latent image on the photoconductive drum 27 by emitting light from an LED based on image data that has undergone photoelectric conversion and image processing for each color.

In the developing device 16, a rotatable developing roller on which a developer is carried turns the electrostatic latent image formed on the photoconductive drum 27 into a visible toner image.

The toner image formed on the photoconductive drum 27 is transferred onto the intermediate transfer belt 14 at a position where the photoconductive drum 27 and the intermediate transfer belt 14 contact each other. Intermediate transfer rollers 26 are positioned so as to face the photoconductive drums 27 across the intermediate transfer belt 14.

The intermediate transfer rollers 26 are in contact with the inner peripheral surface of the intermediate transfer belt 14, and cause the intermediate transfer belt 14 contact the surfaces of the respective photoconductive drums 27. A voltage is applied to each intermediate transfer roller 26 for generating an intermediate transfer electric field by which a toner image formed on the surface of the photoconductive drum 27 is transferred onto the intermediate transfer belt 14. According to this function of the intermediate transfer electric field, toner images of the respective colors are transferred and superposed on the intermediate transfer belt 14 so that a full-color toner image is formed.

When the developing process and the transfer process are completed for all colors, a sheet S is conveyed from a tray 22 at a timing to match a timing of the image on the intermediate transfer belt 14, and the full-color toner image is transferred from the intermediate transfer belt 14 to the sheet by a secondary transfer operation at a secondary transfer unit 50.

In a first tray 22*a*, a second tray 22*b*, a third tray 22*c*, and a fourth tray 22*d*, sheets S of different sizes are accommodated, and a sheet S of any one of the sizes is selected and conveyed. Each of the trays 22*a* through 22*d* includes a supply roller 28 that sequentially sends out sheets S accommodated inside the tray starting from the top sheet S, and a separation roller 31 for preventing double feed where plural sheets S stacked on top of each other are conveyed. With the above described configuration, the sheets S sequentially start being conveyed from the tray 22 to a conveying path 23.

As the sheets S, plain paper is generally used; however, other kinds of sheets may be used, such as glossy paper, cardboard, postcards, OHP transparency films, and films. Furthermore, the length and width of the sheet is not limited, and a continuous sheet may be used.

The sheet S that is supplied from the tray 22 is conveyed to the secondary transfer unit 50 by the sheet conveying device 300 including plural conveying rollers 30 provided along the conveying path 23. The conveying rollers 30 are rotated by a motor acting as a driving unit, so that a sheet S supplied from the tray 22 is passed to the conveying rollers 30 of later stages to guide the sheet S to the secondary transfer unit 50.

The sheet S is conveyed by the conveying path 23, the leading edge of the sheet S is detected by a resist sensor 51, and then the sheet S temporarily stops before the secondary transfer unit 50. Subsequently, the sheet S starts to be conveyed again to the secondary transfer unit 50, at a timing to match a timing when a toner image on the intermediate transfer belt 14 reaches the secondary transfer unit 50.

The sheet S is separated from the intermediate transfer belt 14 by a separator (not shown), and is then conveyed to a fixing device 19 by a conveying belt 24. The fixing device 19 includes a heating roller 25 and a pressurizing roller 12, and applies heat and pressure to a full-color toner image transferred onto the sheet S to fix the image onto the surface of the sheet. The sheet S having a toner image formed on its surface is ejected on a eject tray 21.

In the present embodiment, an electrophotographic type image forming apparatus is used as the image forming apparatus 100 including the sheet conveying device 300; however, another type of image forming apparatus such as an inkjet type may be used.

Configuration of Sheet Conveying Device

Figure 2A:
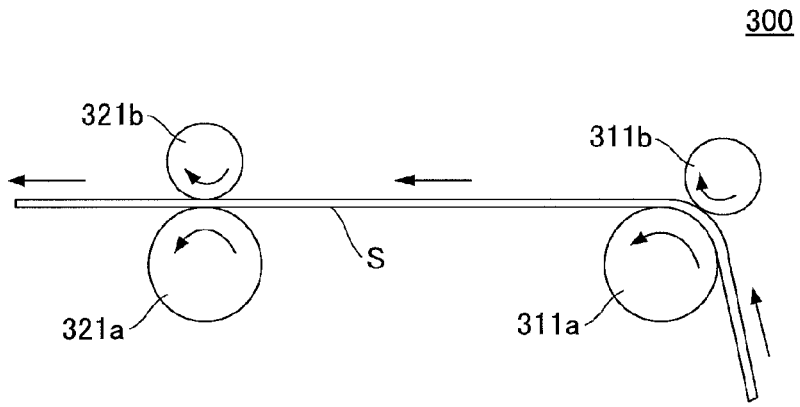
FIGS. 2A and 2B schematically illustrate relevant parts of a sheet conveying device according to the first embodiment.
Figure 2B:
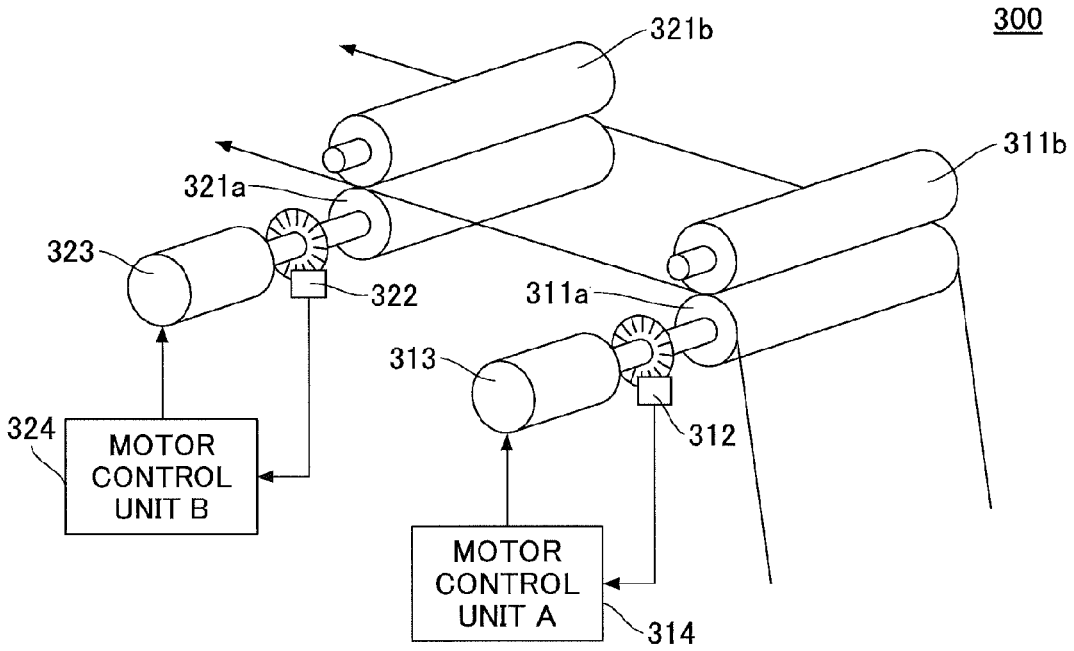

FIGS. 2A and 2B schematically illustrate relevant parts of the sheet conveying device 300 according to the first embodiment. FIG. 2A is a schematic cross-sectional view of relevant parts, and FIG. 2B is a schematic perspective view of relevant parts.

The sheet conveying device 300 detects the thickness of the sheet S when conveying a sheet. Based on the thickness of the sheet S detected by the sheet conveying device 300, the image forming apparatus 100 appropriately sets the transfer voltage of the secondary transfer unit 50 and the fixing temperature of the fixing device 19, so that high quality images can be output.

As illustrated in FIG. 2A, detection of the thickness of the sheet S is performed at the sheet conveying device 300 when the sheet S is conveyed, by using conveying rollers 311 provided at a part where the conveying path of the sheet S curves, and conveying rollers 321 acting as a conveying unit provided at a downstream side in the conveying direction of the sheet S with respect to the conveying rollers 311. As illustrated in FIG. 2A, the sheet S is laid across the conveying rollers 311 and the conveying rollers 321, conveyed by both the conveying rollers 311 and the conveying rollers 321, and then conveyed to a conveying means on the downstream side along the conveying path.

The conveying rollers 311 and 321 respectively include a pair of rollers facing each other. One of the rollers 311*a*, 321*a* in the roller pair is rotated by being connected to a motor acting as a driving unit, and the other one of the rollers 311*b*, 321*b* in the roller pair is subordinately rotated by the rollers 311*a*, 321*a*. Accordingly, the conveying rollers 311 and 321 sandwich the sheet S and convey the sheet S.

Furthermore, as illustrated in FIG. 2B, the conveying roller 311*a* is rotated by being connected to a motor 313 acting as a driving unit, and the rotation speed is detected by an encoder 312. A motor control unit 314 acting as a driving control unit connected to the motor 313 controls the operation of driving the motor 313 based on output from the encoder 312 and the target speed, and therefore controls the rotation speed of the conveying roller 311*a*.

The conveying roller 321*a* acting as a conveying unit provided on the downstream side in the conveying direction of the sheet S with respect to the conveying rollers 311, is also rotated by being connected to a motor 323 acting as a driving unit, and conveys the sheets S. The conveying speed of the sheet S being conveyed by the conveying roller 321*a* is detected by an encoder 322 acting as a conveying speed detecting unit. Furthermore, a motor control unit 324 connected to the motor 323 controls the operation of driving the motor 323 based on output from the encoder 322 and the target speed, to control the rotation speed of the conveying roller 321*a*.

In the present embodiment, the conveying rollers 30 are provided at the curved part of a conveying path through which the sheet S supplied from the tray 22 passes to reach the conveying path 23. Furthermore, the conveying rollers 30 positioned immediately next to the tray 22 function as the conveying rollers 311 on the upstream side shown in FIG. 2A, and another set of conveying rollers 30 positioned on the downstream side of the sheet S conveying direction function as the conveying rollers 321 shown in FIG. 2A.

The result of detecting the sheet thickness is applied to secondary transfer conditions and fixing conditions, and therefore the mechanism for detecting the sheet thickness is preferably provided on the upstream side of the conveying path of the sheet S as much as possible. However, a secondary transfer roller 18 may also act as the conveying rollers 321 on the downstream side. Furthermore, instead of the conveying rollers 321, other conveying means such as a conveying belt may be used.

Figure 3:
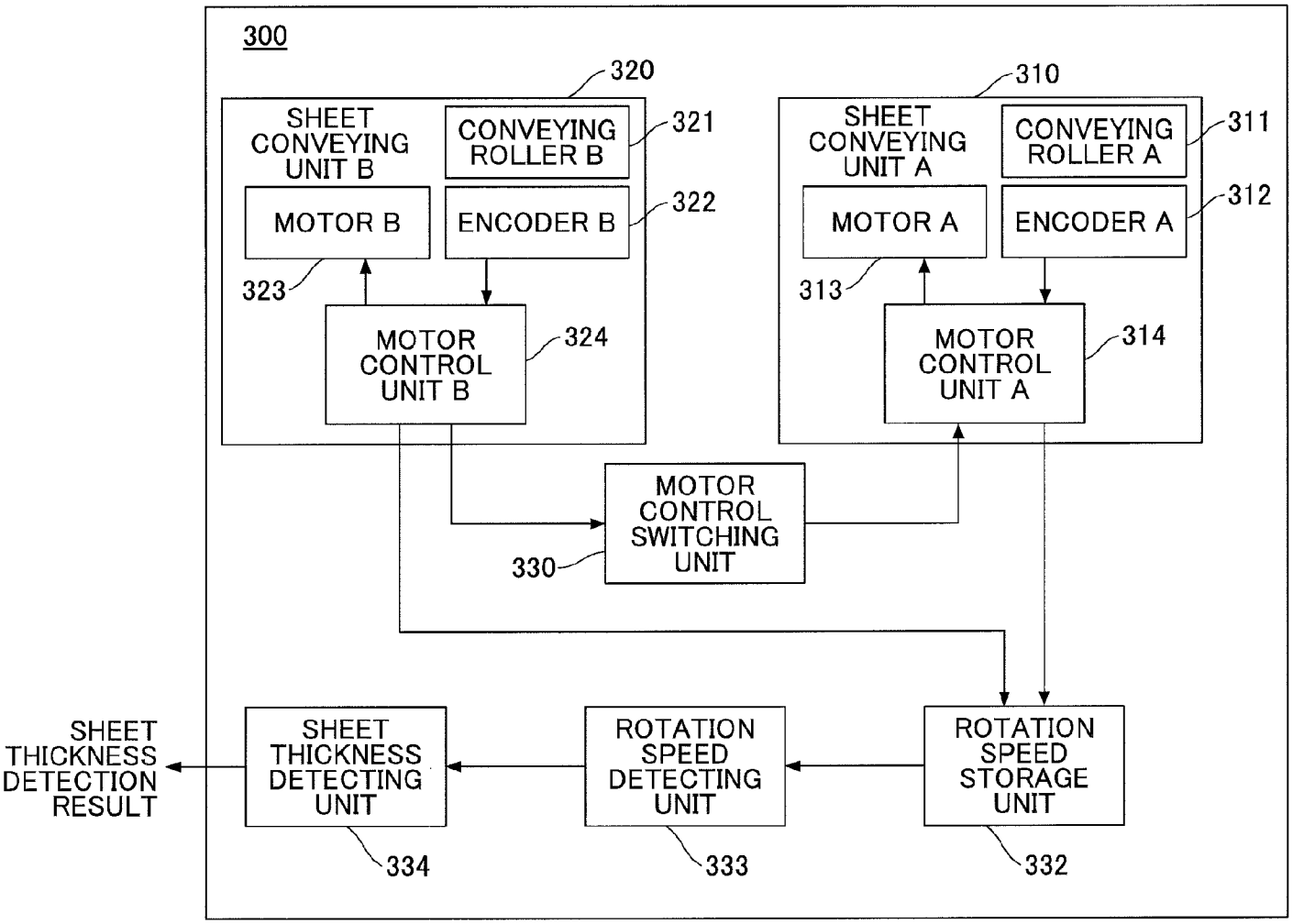
FIG. 3 is a functional block diagram of the sheet conveying device according to the first embodiment.

FIG. 3 is a functional block diagram of the sheet conveying device 300 according to the first embodiment.

The sheet conveying device 300 includes a sheet conveying unit 310 including the conveying rollers 311, the motor 313, the encoder 312, and the motor control unit 314, and a sheet conveying unit 320 including the conveying rollers 321, the motor 323, the encoder 322, and the motor control unit 324. Furthermore, the sheet conveying device 300 includes a motor control switching unit 330 for switching the control of the motor control unit 314, a rotation speed storage unit 332, a rotation speed detecting unit 333, and a sheet thickness detecting unit 334.

The motor control switching unit 330 sends, to the motor control unit 314, a signal for switching control so that the conveying rollers 311 are subordinately rotated (i.e., rotated by the movement of the sheet S that is conveyed by the conveying rollers 321), when the sheet S is passed from the conveying rollers 311 to the conveying rollers 321 on the downstream side.

The rotation speed storage unit 332 temporarily stores the rotation speed of the conveying rollers 311, 321 which is detected by the encoders 312, 322, respectively.

The rotation speed detecting unit 333 detects the rotation speed of the conveying roller 311*a* and the conveying speed of the sheet S being conveyed by the conveying roller 321*a*, based on the rotation speed of the conveying rollers 311*a*, 321*a* during a certain period stored by the rotation speed storage unit 332.

The sheet thickness detecting unit 334 detects the thickness of the sheet S by a method described below based on the conveying speed of the sheet S, the radius of the conveying roller 311*a*, and the rotation speed of the conveying roller 311*a*, and outputs the detection result.

Figure 4:
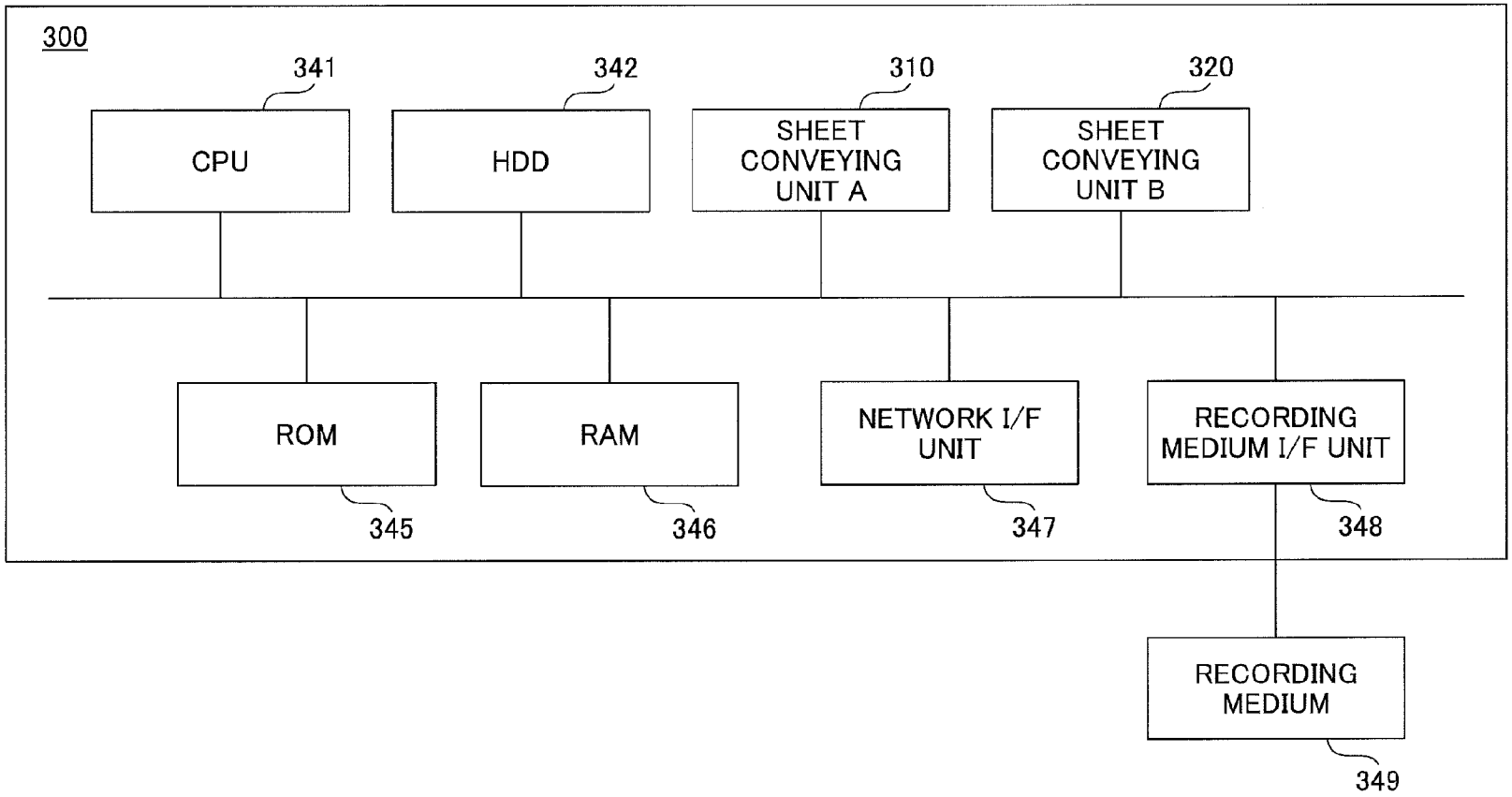
FIG. 4 illustrates a hardware configuration of the sheet conveying device according to the first embodiment.

FIG. 4 illustrates a hardware configuration of the sheet conveying device 300.

The sheet conveying device 300 includes a CPU (Central Processing Unit) 341, a HDD (Hard Disk Drive) 342, a sheet conveying unit A 310, a sheet conveying unit B 320, a ROM (Read-Only Memory) 345, a RAM (Random Access Memory) 346, a network I/F unit 347, and a recording medium I/F unit 348, which are interconnected by a bus.

The CPU 341 performs control and calculation and processing on data in the computer, and executes programs stored in the ROM 345 and the RAM 346. The CPU 341 controls the overall device by executing programs, and functions as the motor control switching unit 330, the rotation speed detecting unit 333, and the sheet thickness detecting unit 334.

The HDD 342 is a non-volatile storage device for storing various programs and data. Examples of the stored programs and data include an OS (Operating System) and applications for providing various functions.

The ROM 345 is a non-volatile semiconductor memory (storage device) that can hold internal data even after the power is turned off. Furthermore, the RAM 346 is a volatile semiconductor memory (storage device) for temporarily holding programs and data. The rotation speed of the conveying rollers 311 and the conveying rollers 321 is temporarily stored in the RAM 346.

The network I/F unit 347 is an interface between the sheet conveying device 300 and a peripheral device having a communication function that is connected via a network such as LAN (Local Area Network) and WAN (Wide Area Network) constituted by a wired and/or wireless data transmission path.

The recording medium I/F unit 348 is an interface between the sheet conveying device 300 and a computer-readable recording medium 349 such as a flash memory connected via a data transmission path such as USB (Universal Serial Bus), a CD-ROM, a flexible disk (FD), a CD-R, and a DVD (Digital Versatile Disk).

The recording medium 349 stores a predetermined program. The program stored in the recording medium 349 is installed in the sheet conveying device 300 via the recording medium I/F unit 348, and the installed predetermined program can be executed by the CPU 341.

Method of Detecting Sheet Thickness

Figure 5:
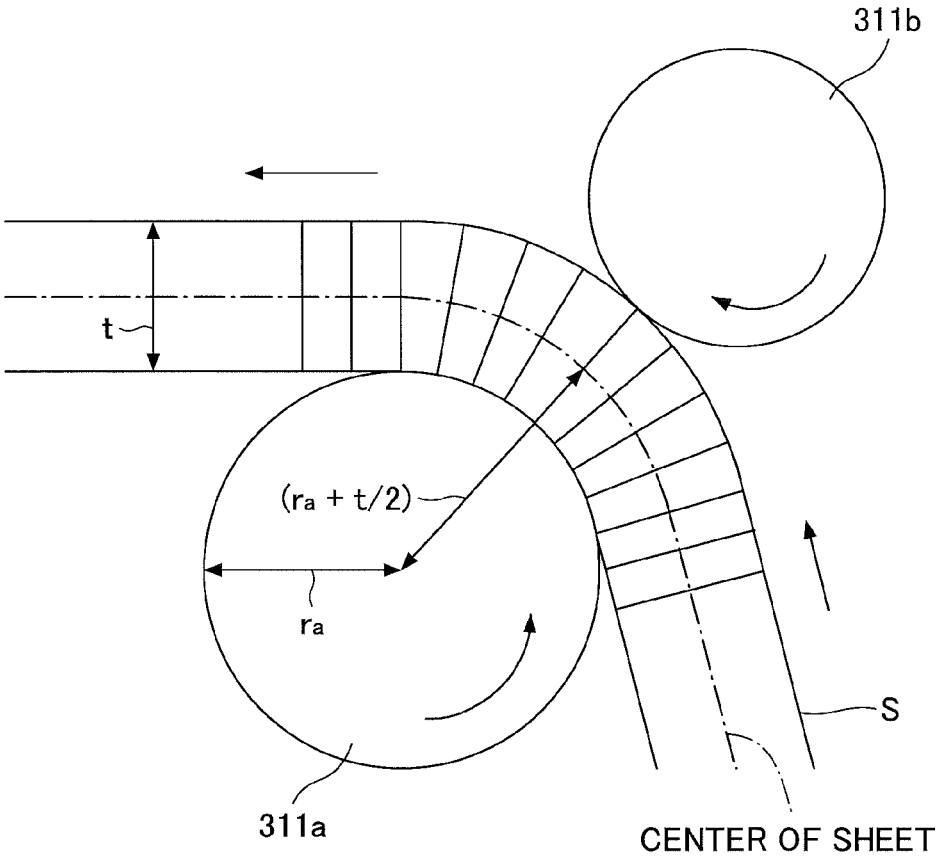
FIG. 5 illustrates a method of detecting sheet thickness performed by the sheet conveying device according to the first embodiment.

Next, a description is given of a method of detecting sheet thickness with reference to FIG. 5 illustrating an enlarged view of the sheet conveying device 300 according to the present embodiment.

The sheet S is conveyed in a manner as to contact and wind around the rotating conveying roller 311*a* at a certain angle. At the curved part of the conveying path, on the inner peripheral side of the curved part of the conveying path of the sheet S, the side of the sheet S contacting the conveying roller 311*a* is conveyed in a shortened state in the conveying direction of the sheet S. Furthermore, on the outer peripheral side of the curved part of the conveying path of the sheet S, the side of sheet S contacting the conveying roller 311*b* is conveyed in a extended state in the conveying direction of the sheet S.

Therefore, for example, when the conveying rollers 321 on the downstream side are driven to convey the sheet S at a fixed speed, and the conveying rollers 311*a* and 311*b* are subordinately rotated, the conveying rollers 311*a* and 311*b* rotate at different rotation speeds due to the shortened and extended sides of the sheet S contacting the conveying rollers 311*a* and 311*b*, respectively.

At this time, assuming that the conveying speed of the sheet S is Vs, the side of the sheet S on the inner peripheral side of the conveying path is shortened in the conveying direction, and therefore this side moves at a speed that is lower than Vs. Meanwhile, the side of the sheet S on the outer peripheral side of the conveying path is extended in the conveying direction, and therefore this side moves at a speed that is higher than Vs. The center part of the sheet S in the thickness direction is neither shortened or extended, and is thus conveyed at a the conveying speed Vs.

At this time, the conveying speed of the center part in the thickness direction of the sheet S at the curved part of the conveying path is equal to the surface speed of the rotation of a circle having a radius obtained by adding the radius of the conveying roller 311*a* on the inner peripheral side of the curved part of the conveying path of the sheet S with the length from the conveying roller 311*a* to the center of the sheet S.

The conveying speed Vs of the sheet S can be expressed by the following formula, where the rotation speed of the conveying roller 311*a* is Va and the thickness of the sheet S is t.

Formula 1

$$V_s = \left(\frac{r_a + t/2}{r_a}\right) \times V_a \tag{1}$$

Vs: conveying speed of sheet S
Va: rotation speed of conveying roller 311*a*
ra: radius of conveying roller 311*a*
t: thickness of sheet S From the above formula 1, the thickness t of the sheet S can be obtained by the following formula 2.

Formula 2

$$t = 2r_a \times \left(\frac{V_s}{V_a} - 1\right) \tag{2}$$

As described above, as the sheet S is shortened/extended at the curved part of the conveying path, by using the difference in the conveying speed along the thickness direction, the thickness of the sheet S can be obtained based on the conveying speed of the sheet S and the rotation speed of the conveying roller 311 that is subordinately rotated.

As the conveying speed of the sheet S, a conveying speed of the sheet S set in advance in the sheet conveying device 300 may be used. The rotation speed of the conveying roller 321*a* on the downstream side that is detected by the encoder 322 may be used as the conveying speed of the sheet S.

Figure 6:
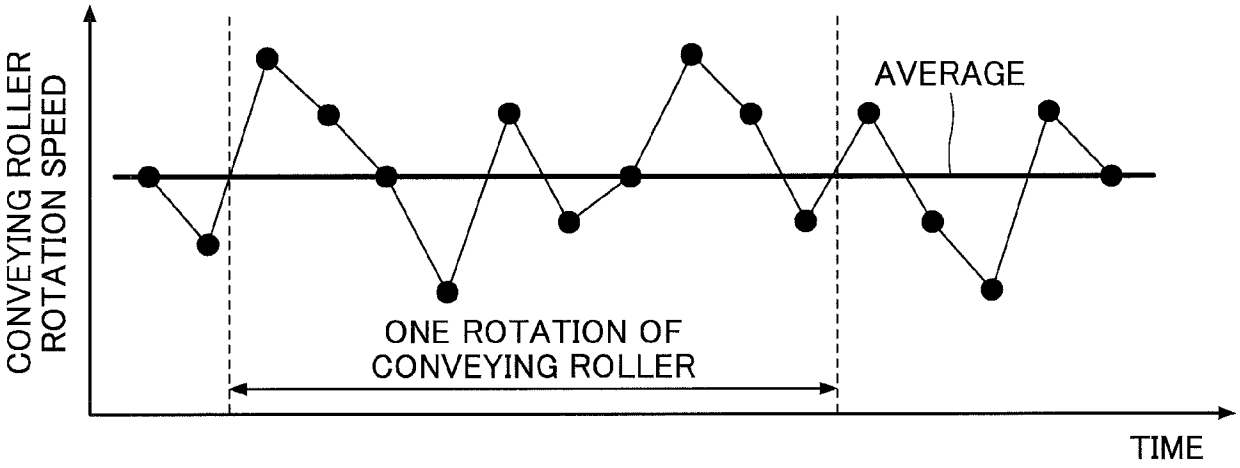
FIG. 6 illustrates a method of detecting the motor rotation speed performed by the sheet conveying device according to the first embodiment.

Furthermore, when the encoders 312, 322 detect the rotation speed of the conveying rollers 311*a*, 321*a*, as shown in FIG. 6, the rotation speed is preferably detected by averaging the output values from the encoders 312, 322 while the conveying rollers rotate more than once. This is because the rotation speed may vary due to the eccentricity of the conveying rollers 311*a*, 321*a* and inconsistency in the thickness in the conveying direction of the sheet S that is conveyed.

In the sheet conveying device 300 according to the present embodiment, as shown in FIG. 3, the rotation speed of the conveying rollers 311*a*, 321*a* detected by the encoders 312, 322 is temporarily stored in the rotation speed storage unit 332. The rotation speed stored in the rotation speed storage unit 332 is averaged by the rotation speed detecting unit 333 to detect the rotation speed. When the rotation speed is detected, the sheet thickness detecting unit 334 uses the above formula 2 to detect the sheet thickness, and outputs a sheet thickness detection result.

Activation Control of Motor

Figure 7:
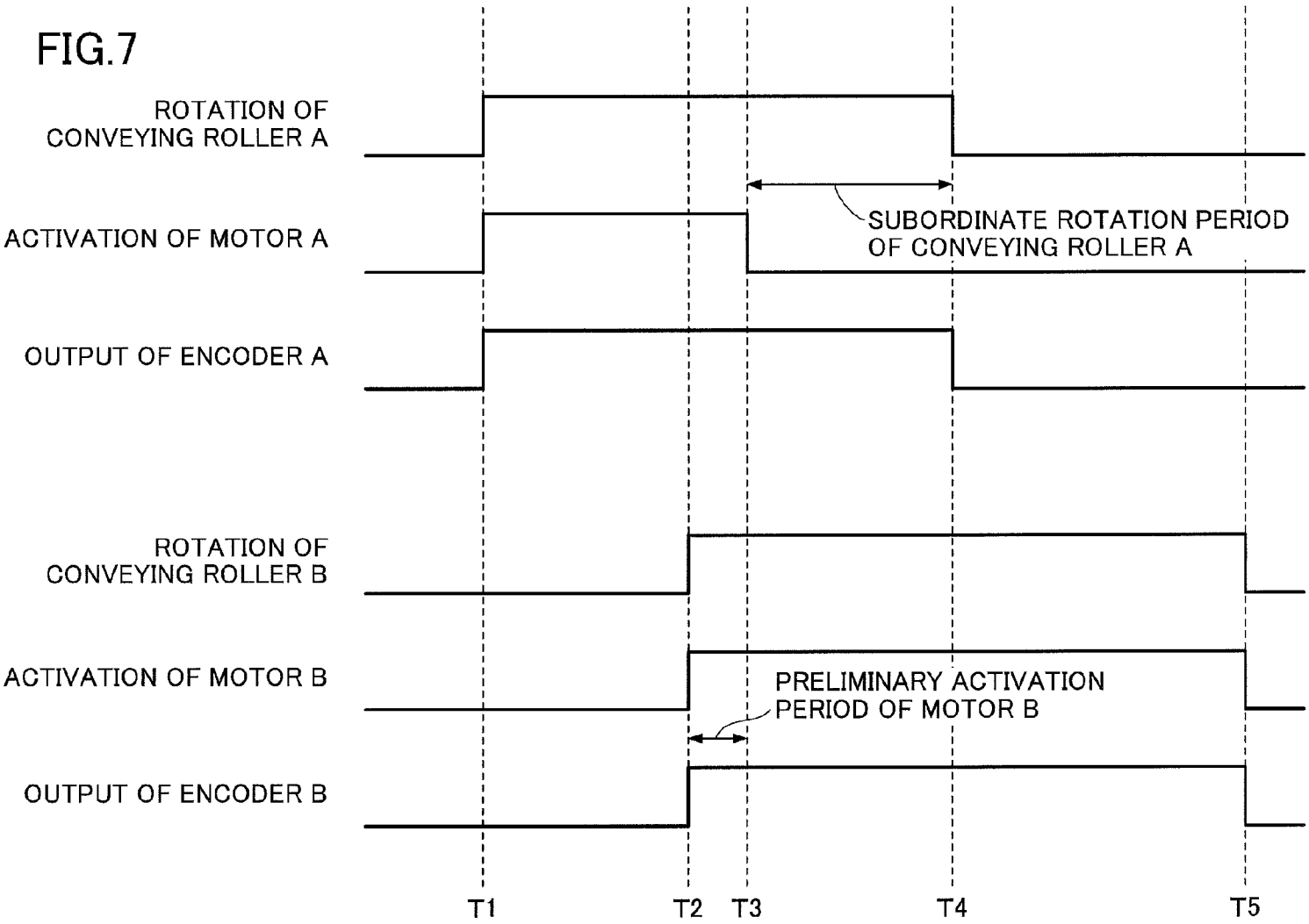
FIG. 7 is a timing chart of the sheet conveying device according to the first embodiment.

FIG. 7 is a timing chart of the sheet conveying device 300 according to the first embodiment.

First, at time T1, the motor 313 (hereinafter, "motor A") is activated, the conveying roller 311*a* (hereinafter, "conveying roller A") on the upstream side is rotated, and the sheet S starts to be conveyed. As the conveying roller A is rotated, the encoder 312 (hereinafter, "encoder A") starts to output detection results.

The sheet S is conveyed by the conveying roller A, and at a time T2 before the sheet S is passed to the conveying roller 321*a* on the downstream side, the motor 323 (hereinafter, "motor B") is activated and the conveying roller 321*a* (hereinafter, "conveying roller B") is rotated. As the conveying roller B is rotated, the encoder 322 (hereinafter, "encoder B") starts to output detection results.

The time period from a time T2 when the motor B starts to activate to a time T3 when the sheet S reaches the conveying roller B is the preliminary activation period of the motor B. By providing this preliminary activation period, the sheet S can be smoothly passed and conveyed from the conveying roller A to the conveying roller B.

At time T3, when the sheet S reaches the conveying roller B, activation of the motor A is stopped, and the conveying roller A is subordinately rotated. Output from the encoder A is continued even while the conveying roller A is subordinately rotated.

At a time T4 when the trailing edge of the sheet S passes the conveying roller A, the rotation of the conveying roller A is stopped, and output from the encoder A is stopped.

Even after the sheet S passes through the conveying roller A, the conveying roller B on the downstream side conveys the sheet S. At a time T5 when the sheet S is passed to a conveying roller further downstream, the activation of the motor B is stopped, and the rotation of the conveying roller B and output from the encoder B are stopped.

The rotation speed of the conveying roller A during the time period between the time T3 and the time T4 is detected, and the sheet thickness is detected by the above formula 2. The time period between the time T3 and the time T4 is when the conveying roller B conveys the sheet S and the conveying roller A is subordinately rotated.

Figure 8:
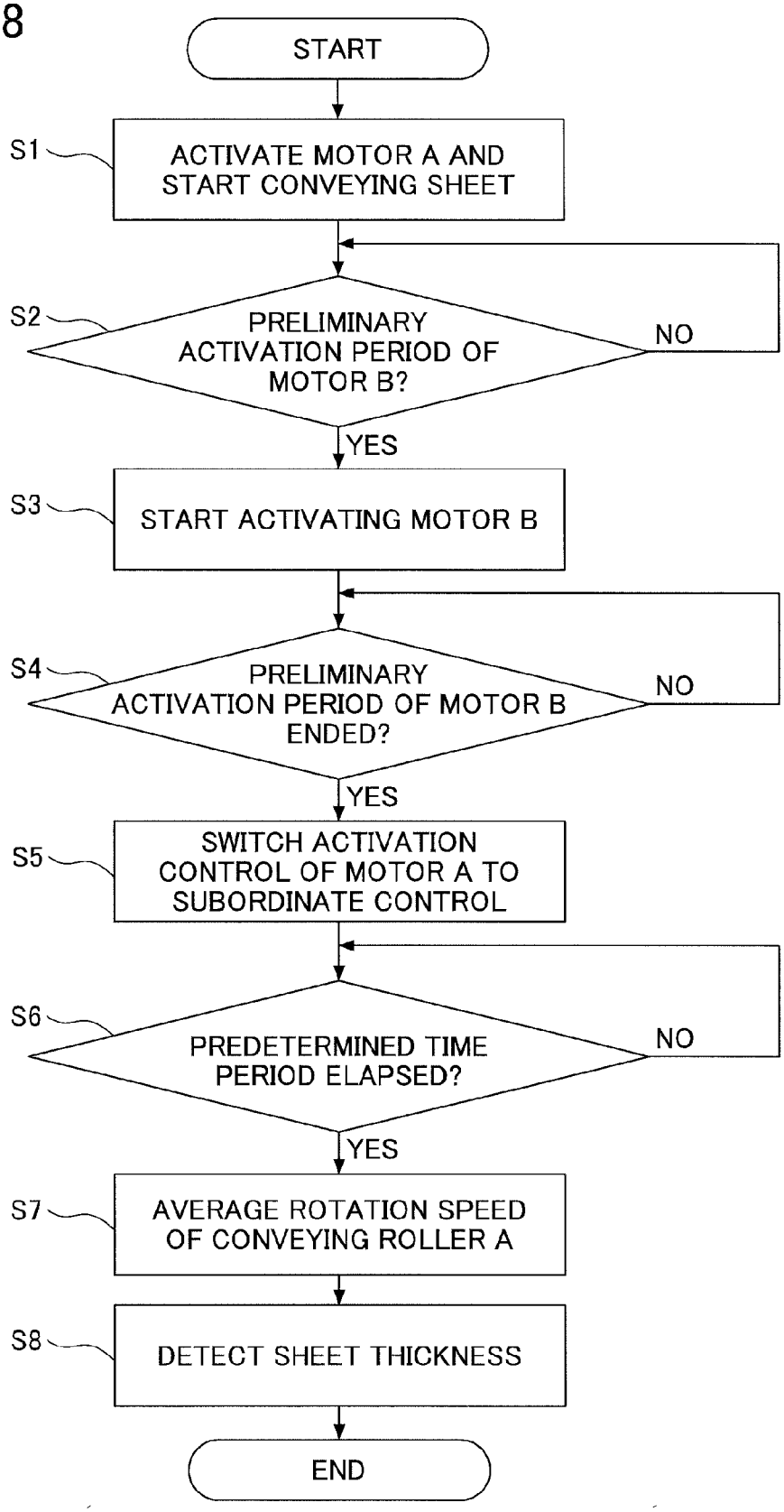
FIG. 8 illustrates a flowchart of a process of detecting the sheet thickness performed by the sheet conveying device according to the first embodiment.

FIG. 8 illustrates a flowchart of a process of detecting the sheet thickness performed by the sheet conveying device 300 according to the first embodiment.

First, in step S1, the motor A is activated and the sheet S starts to be conveyed. Next, in step S2, when the preliminary activation period of the motor B starts, in step S3, activation of the motor B is started.

Next, in step S4, when the preliminary activation period of the motor B ends, and the sheet S reaches the conveying roller B, in step S5, the motor control switching unit 330 switches the activation control of the motor A to subordinate control described below.

In step S6, when it is determined that the conveying roller A has been subordinately rotated by the sheet S for more than a predetermined amount of time, in step S7, the rotation speed detecting unit 333 obtains the rotation speed of the conveying roller A by averaging the rotation speed. When the rotation speed of the conveying roller A is detected, in step S8, the sheet thickness detecting unit 334 detects the sheet thickness based on the above formula 2, and the process ends.

By the above process, the sheet conveying device 300 detects the rotation speed of the conveying roller A and obtains the thickness of the sheet S.

Subordinate Control of Motor A

Figure 9:
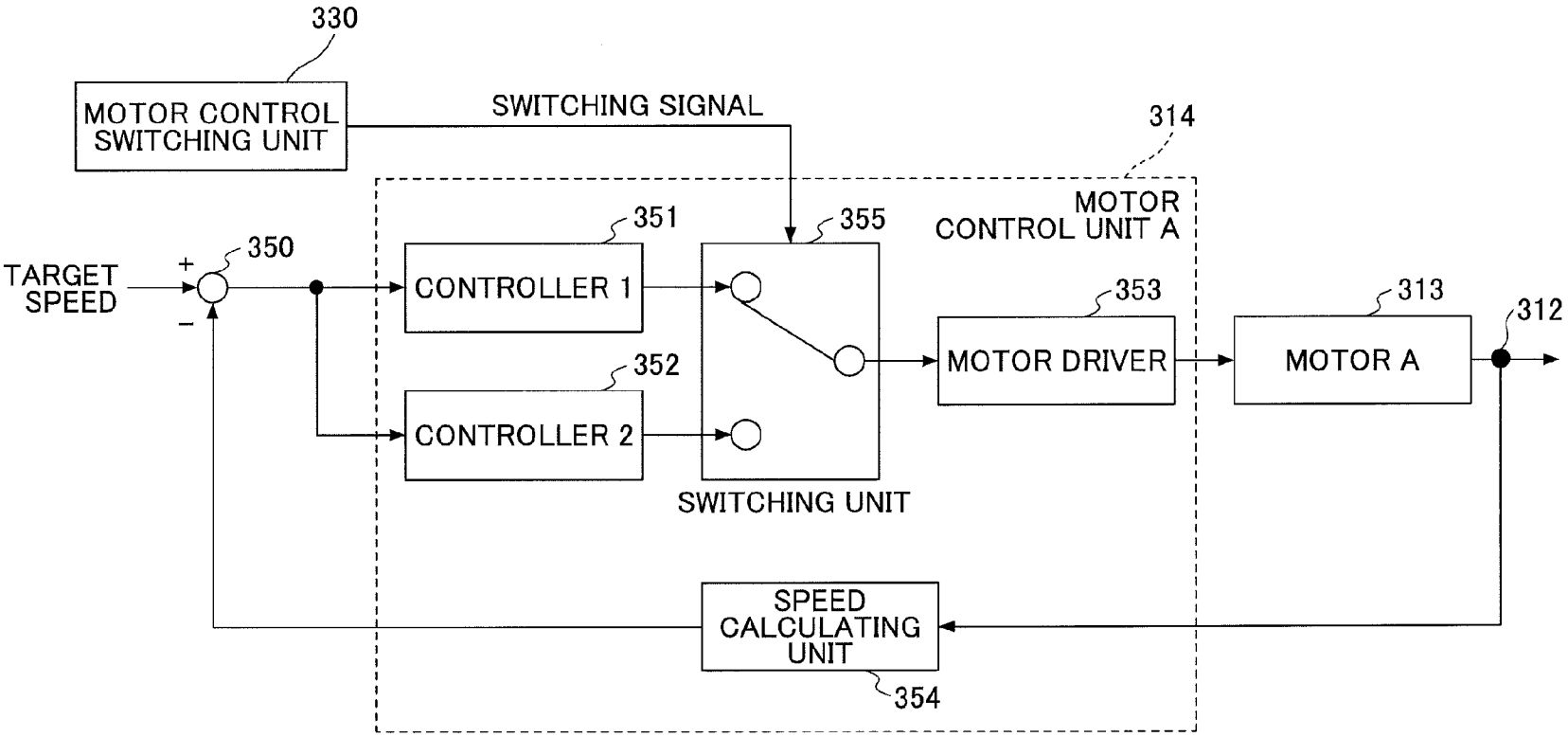
FIG. 9 is a control block diagram of the motor A of the sheet conveying device according to the first embodiment.

FIG. 9 is a control block diagram of the motor A of the sheet conveying device 300 according to the first embodiment. FIG. 9 illustrates a feedback loop for controlling the rotation speed of the motor A.

The control system of the motor A includes a motor control switching unit 330, a comparator 350, a motor control unit 314 (hereinafter, "motor control unit A"), a motor A 313, and an encoder 312 (hereinafter, "encoder A"). The motor control unit A includes a controller 351 (hereinafter, "controller 1"), a controller 352 (hereinafter, "controller 2"), a switching unit 355, a motor driver 353, and a speed calculating unit 354.

The comparator 350 outputs, to the controller 1 and the controller 2, a comparison result obtained by comparing the rotation speed detected by the encoder A and calculated by the speed calculating unit 354 with a target rotation speed (hereinafter, "rotation speed").

The controller 1 and the controller 2 perform calculation in accordance with PI control, and determine the speed to be instructed to the motor driver 353. This target speed is determined so that the conveying speed of the sheet S conveyed by rotation of the motor A becomes a predetermined speed. Only one of the controller 1 and the controller 2 operates at a time.

When only the conveying roller A conveys the sheet S, the controller 1 instructs a speed to the motor driver 353. When the sheet S is conveyed by being laid across the conveying roller A and the conveying roller B, the controller 2 instructs a speed to the motor driver 353.

The switching between the controller 1 and the controller 2 is performed according to a switching signal output by the motor control switching unit 330. As switching signals, there are signals for switching from the controller 1 to the controller 2 when the sheet S enters the conveying roller B, and signals for switching from the controller 2 to the controller 1 when the sheet A passes from the conveying roller A.

The detection of when the sheet S enters the conveying rollers A and B is performed when a current sensor in a motor driver included in each of the motor control units A and B detects a driving current flowing in the motor driver. Furthermore, it is possible to obtain the time when the sheet S enters/passes through the conveying rollers A and B based on the conveying time of the sheet S that is conveyed at a predetermined speed in a predetermined conveying path.

The controller 1 and the controller 2 respectively perform multiplication of a predetermined gain and a predetermined filtering process on the speed deviation between the target speed and the rotation speed calculated by the speed calculating unit 354, and outputs the obtained value as a speed instruction value to the motor driver 353.

The controller 1 and the controller 2 may use any of the compensation methods among a classical control theory such as PI, PID, phase lead, and phase lag; a state feedback theory based on a modern control theory of feeding back the state amount of a transfer timing roller; and a robust control theory typified by $H^{\infty}$ control.

The motor driver 353 is a current control driver for outputting a motor current according to the speed instruction value (or a voltage control driver for outputting a motor voltage according to the voltage instruction value). The motor A is driven by a driving current output from the motor driver 353 according to the speed instruction value. As the motor A is driven, the conveying roller A is rotated via a transmission mechanism.

As the motor A, a DC motor (with or without a brush), an AC servomotor, and a stepping motor may be used.

The rotation speed of the motor A is obtained by detection by the encoder A and calculation by the speed calculating unit 354, converted into a value that can be compared with the target speed, and is fed back to the comparator 350. The speed may be calculated by a method of using the difference in counter values of encoder pulses, or a period counter method of measuring the edges of encoder pulses with a reference clock. The speed calculating unit 354 may be included in the encoder A.

Speed Compensation of Controller 2

At the time point when the sheet S enters the conveying roller B and is laid across the conveying roller A and the conveying roller B, the motor control switching unit 330 switches the control of the motor A from the controller 1 to the controller 2. The controller 2 controls the motor A so that the conveying roller A is subordinately rotated by the sheet S being conveyed by the conveying roller B.

A description is given of speed compensation performed by the controller 2 in this case. In the case of a software servo where speed compensation is performed by software, the controller 1 and the controller 2 respectively perform speed compensation by switching the formula used for calculating the current instruction value or by changing the parameters using the same formula.

For example, when a software servo is implemented with a PI (proportion and integration) filter according to a classical control theory used in a general motor driving system, the formula for calculating a current instruction value is as follows.

Formula 3

$$y(n) = kp \times \left(1 + \frac{z}{z-1} \times ts \times ki\right) \times u(n) \tag{3}$$

In formula 3, u(n) is the speed deviation and y(n) is the speed instruction value. The sampling time is a period by which the rotation speed is detected by the encoder A or the calculation period of the speed instruction value. By changing the proportion constant kp and the integration constant ki that are parameters indicating the gain, the controller 1 and the controller 2 are switched.

The proportion constant kp and the integration constant ki of the controller 1 are set in advance so that appropriate speed compensation can be attained when only the motor A conveys the sheet S.

Figure 10:
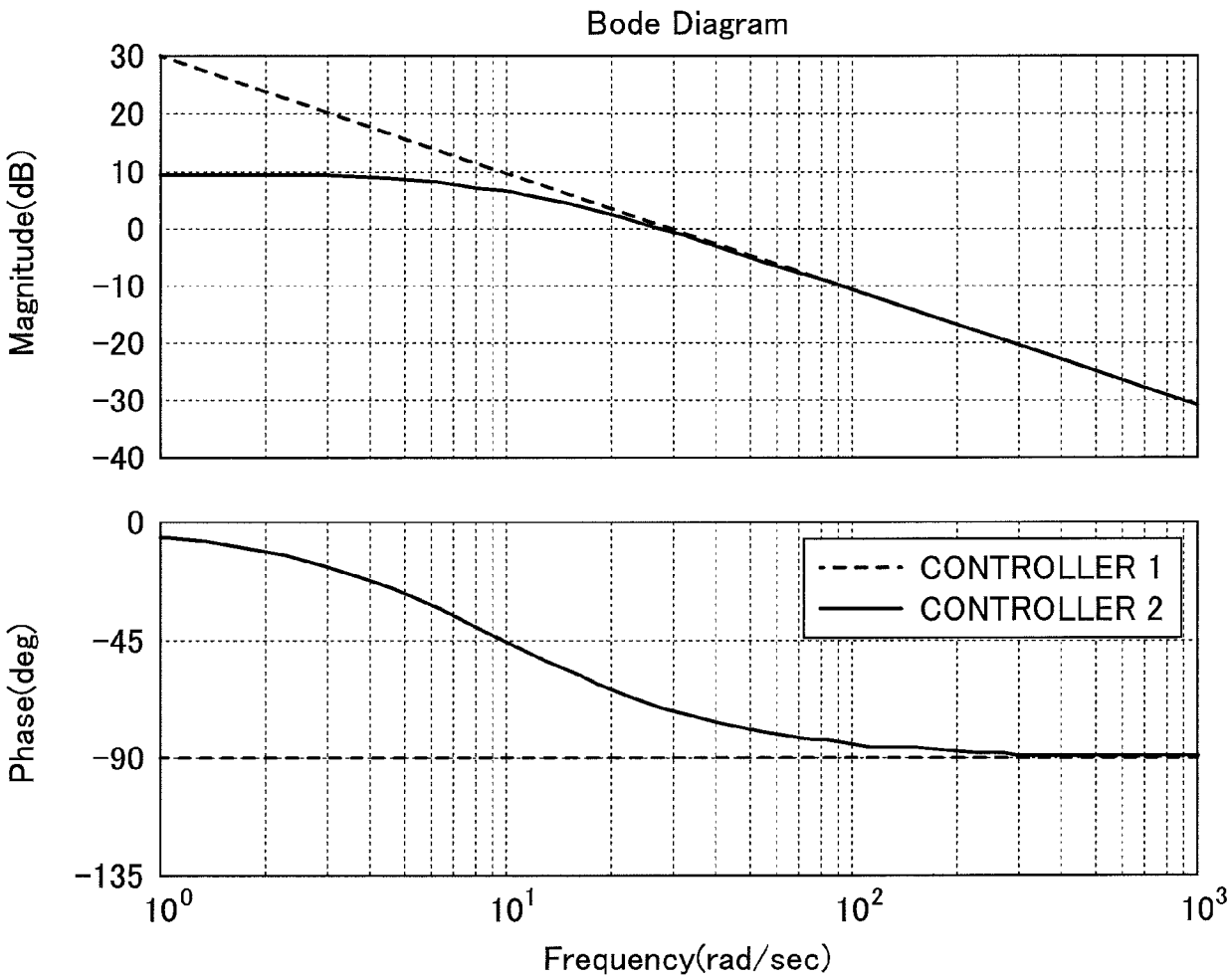
FIG. 10 illustrates a bode diagram.

FIG. 10 illustrates a bode diagram, and a description is given of a case where only the integration constant ki is set to zero. In FIG. 10, the gain curve and the phase curve of the controller 1 are indicated with dashed lines and the gain curve and the phase curve of the controller 2 are indicated with solid lines.

As indicated by the gain curve of the controller 2, in formula 3, when the integration constant ki of the controller 2 is set to zero, the integration characteristics are zero. Therefore, the gain in low frequency areas becomes lower than the gain of the controller 1. That is to say, the responsiveness in low frequency areas is lowered.

The gain in low frequency areas indicates the extent to which the rotation speed is to be compensated with respect to variations in moderate speed deviations. Particularly, the gain in low frequency areas indicates the extent of compensation with respect to DC components in the speed deviation. Therefore, the gain curve of the controller 2 means that the gain in low frequency areas is lowered and there is no compensation of DC components.

Immediately after the sheet S enters the conveying roller B, due to this enter load, the rotation speed of the conveying roller B decreases. Here, setting the integration constant ki to zero and only controlling the proportion means that a stationary speed deviation (deviation of the rotation speed with respect to the target speed) occurs.

In proportion control, when the control amount approaches the target value, the rotation speed becomes stable near the target value. Even if the integration constant ki is zero, by the function of the proportion constant kp, the conveying roller A assists the conveying load of the sheet S, but acts like a subordinate roller of the conveying roller B.

Meanwhile, in the bode diagram of FIG. 10, the gain curve of the controller 2 becomes approximately the same value as the gain curve of the controller 1 in the high frequency areas. Therefore, the motor control unit A controls the rotation speed of the motor A to follow rapid changes in the speed.

Figure 11:
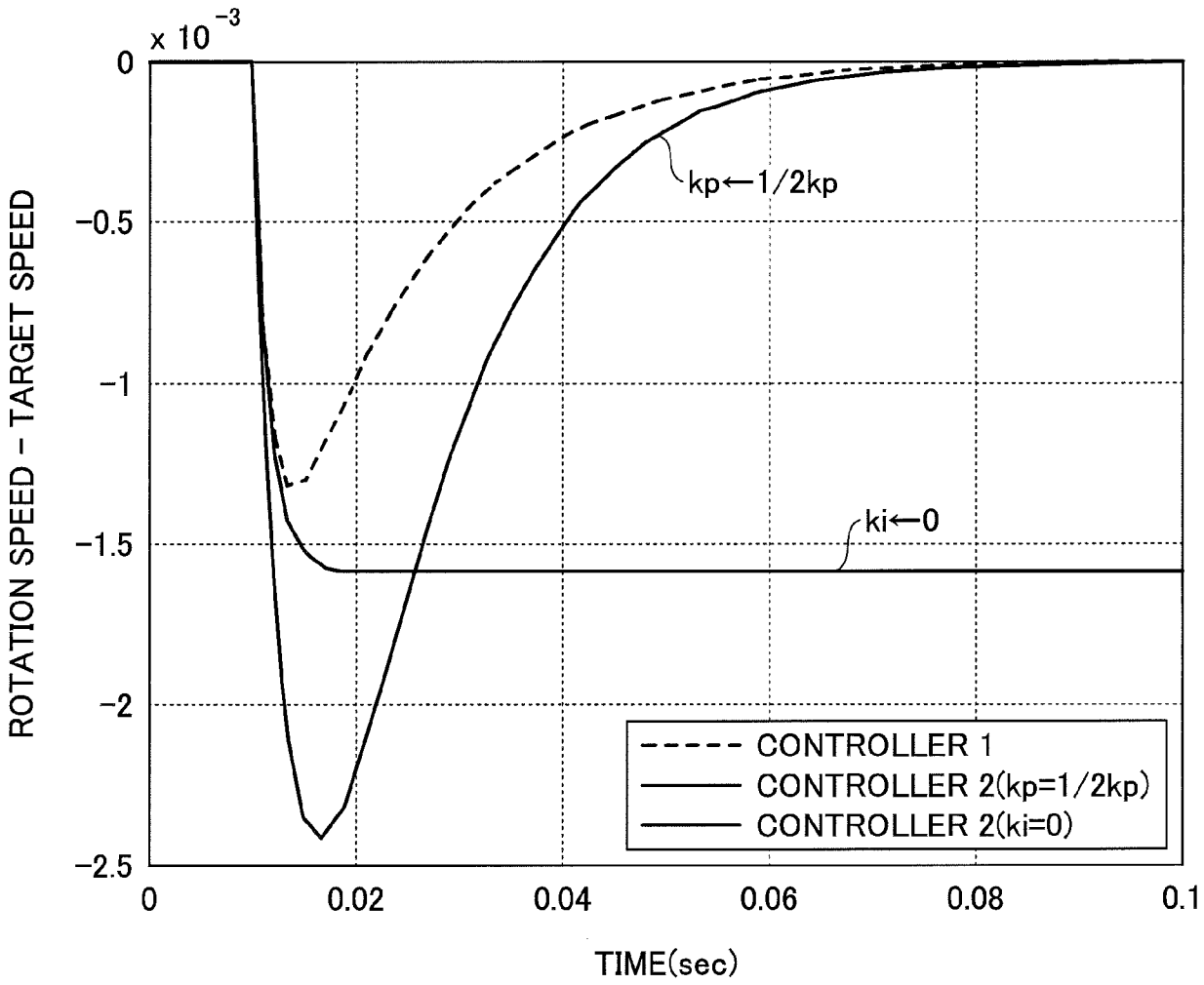
FIG. 11 indicates an example of the relationship between time and speed deviation.

FIG. 11 indicates an example of the relationship between time and speed deviation, and a more detailed description is given. The speed deviation of the vertical axis in FIG. 11 expresses "rotation speed−target speed". Negative values express that the rotation speed is lower than the target value. The speed deviation may be expressed by any kind of unit such as [rad/sec], and may be expressed by percentages.

In FIG. 11, at the time 0.01 seconds, the sheet S enters the conveying roller B. At the controller 1, the rotation speed of the conveying roller A rapidly decreases due to the enter load, but the speed deviation approaches near zero with time. Meanwhile, the controller 2, at which the integration constant ki is set to zero, can respond to speed variations in high frequency areas in a similar manner to the controller 1. Therefore, although the rotation speed of the conveying roller A rapidly decreases due to the enter load, subsequently, the speed deviation is controlled to be come constant.

The speed deviation at this time is a negative value, and therefore the rotation speed of the conveying roller A is lower than that of the conveying roller B, and the conveying roller A acts like a subordinate roller of the conveying roller B while applying a slight tension to the sheet S. As described above, the control operation of setting the integration constant ki to zero becomes the control operation of decreasing the responsiveness to the speed control at least in a predetermined low frequency area.

In the present embodiment, the integration constant ki of the controller 2 is set to zero. However, the same effects can be attained even if the integration constant ki of the controller 2 is not set to zero, as long as the integration constant ki of the controller 2 is sufficiently lower than the integration constant ki of the controller 1.

For example, the integration constant ki of the controller 2 may be one tenth of the integration constant ki of the controller 1. Furthermore, the same effects can be attained by setting the integration constant ki of the controller 2 to be half the integration constant ki of the controller 1. As described above, for example, the integration constant ki of the controller 2 may be designed to be between zero and less than half the integration constant ki of the controller 1.

As described above, while the sheet S is being conveyed by both the conveying roller A and the conveying roller B, the controller is switched to the controller 2 in which the integration constant ki of the PI control system is, for example, zero, and the motor A is controlled. Therefore, the conveying roller A is controlled to be subordinately rotated by the sheet S being conveyed by the conveying roller B.

Modification 1

In the above first embodiment, the integration constant ki of the controller 2 is zero. However, there may be a case where only the proportion constant kp of the controller 2 is low or a case where both the proportion constant kp and the integration constant ki of the controller 2 are smaller than the proportion constant kp and the integration constant ki of the controller 1. The subordinate control of the conveying roller A may be realized by setting the proportion constant kp and the integration constant ki of the controller 2 as described above.

Figure 12:
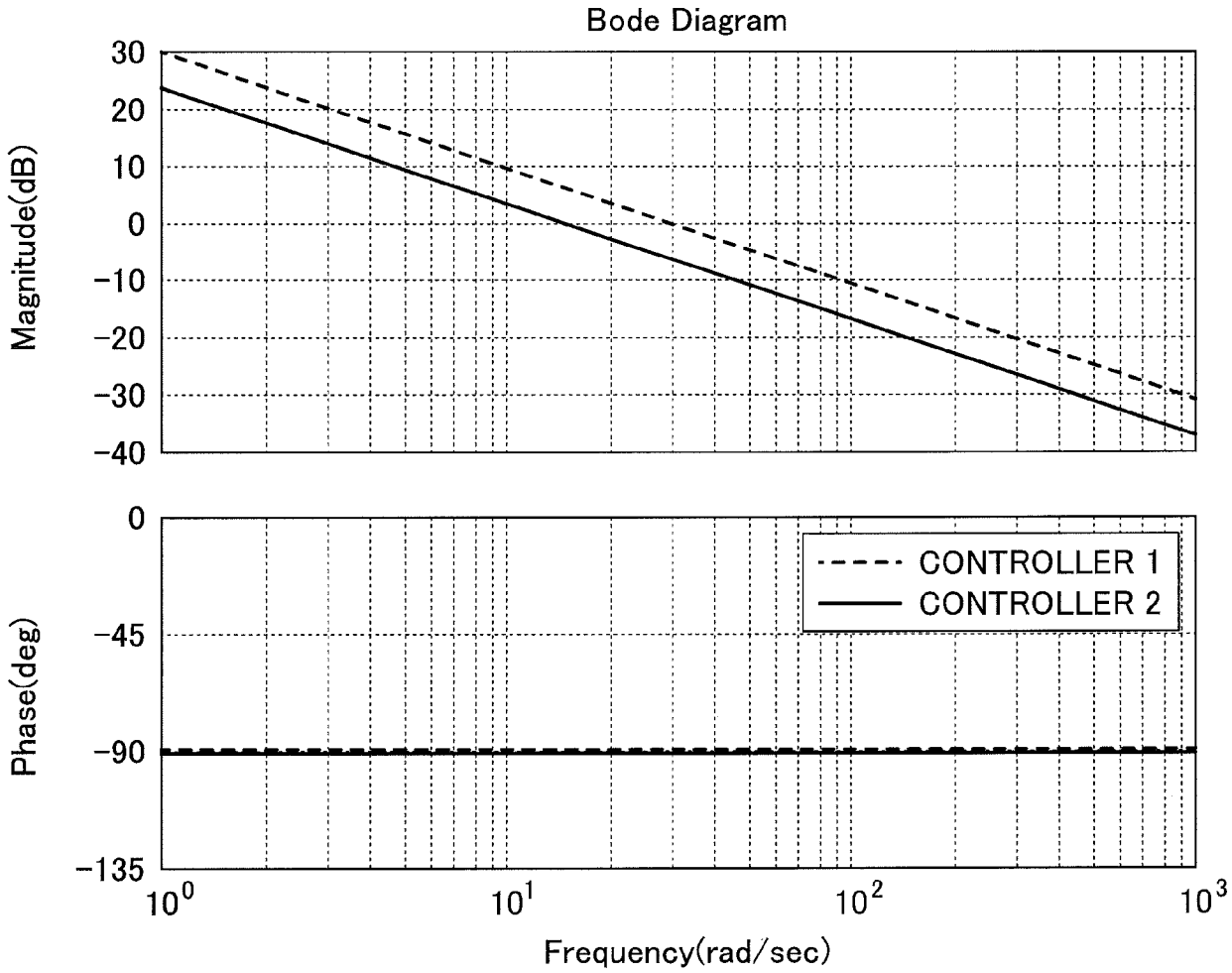
FIG. 12 illustrates a bode diagram of a case where the proportion constant of the controller 2 is half that of the controller 1.

FIG. 12 illustrates a bode diagram of a case where the proportion constant kp of the controller 2 is half that of the controller 1. In FIG. 12, the gain curve and the phase curve of the controller 1 are indicated with dashed lines and the gain curve and the phase curve of the controller 2 are indicated with solid lines.

As shown in FIG. 12, the gain curve of the controller 2 is lower than the gain curve of the controller 1, while maintaining −20 [db/decade] known as the tilt of an integrator.

The response frequency of the controller 1 is 30 [rad/sec], while the response frequency of the controller 2 is 15 [rad/sec]. Therefore, it can be seen that the response frequency declines in accordance to the decrease in the proportion constant kp.

A decrease in the response frequency means a decrease in the gain, which means a decrease in the compensation with respect to the variation (AC component) in the rotation speed generated at the conveying roller A. That is to say, the responsiveness decreases across the entire frequency area. Therefore, the impact of the torque of the conveying roller A with respect to the conveying roller B is reduced. Generally, a control system is susceptible to excessive responses. Therefore, the excessive response when the sheet S enters the conveying roller B can be improved.

A detailed description is given with reference to FIG. 11. In the example shown in FIG. 11, the sheet S enters the conveying roller B at the time 0.01 second. The controller 2 (having a proportion constant kp that is half the proportion constant kp of the controller 1) has a greater speed variation than that of the controller 1, when the rotation speed of the conveying roller A rapidly decreases due to the enter load.

This means that the impact of the conveying roller A on the conveying roller B has decreased, with respect to rapid speed variations. That is to say, by making the gain of the controller 2 lower than the gain of the controller 1, the torque interference between the conveying roller B and the conveying roller A is reduced.

Furthermore, the gain indicates the extent of speed compensation. Therefore, a decrease in the gain also means that the impact of the torque of the conveying roller A on the conveying roller B has decreased regardless of the frequency area.

As shown in FIG. 11, there is a time lag until the rotation speed of the conveying roller A reaches the target speed. During that time, the rotation speed of the conveying roller A becomes lower than that of the conveying roller B. Therefore, compared to a case of setting the integration constant ki of the controller 2 to zero, a small tension is applied to the sheet S, and the conveying roller A is subordinately rotated.

In the above description, the proportion constant kp of the controller 2 is half the proportion constant kp of the controller 1. However, the proportion constant kp of the controller 2 may be three quarters of the proportion constant kp of the controller 1, or one third through one fifth of the proportion constant kp of the controller 1. As described above, the extent to which the proportion constant kp of the controller 2 is reduced with respect to the proportion constant kp of the controller 1 may be appropriately designed.

Furthermore, in addition to reducing the proportion constant kp of the controller 2 with respect to the proportion constant kp of the controller 1, the integration constant ki of the controller 2 may bet set to zero. By making this setting, the tension applied from the conveying roller A to the sheet S is further reduced, and the conveying roller A is subordinately controlled. Furthermore, the gain is reduced across the entire frequency area of the control system, and therefore the responsiveness can be reduced overall.

Modification 2

As described above, by appropriately switching between the controller 1 and the controller 2, subordinate control of the conveying roller A can be performed. Furthermore, a certain torque instruction value may be given to the motor driver 353 instead of the controller 2, to control the conveying roller A to be subordinately rotated by the sheet S.

Figure 13:
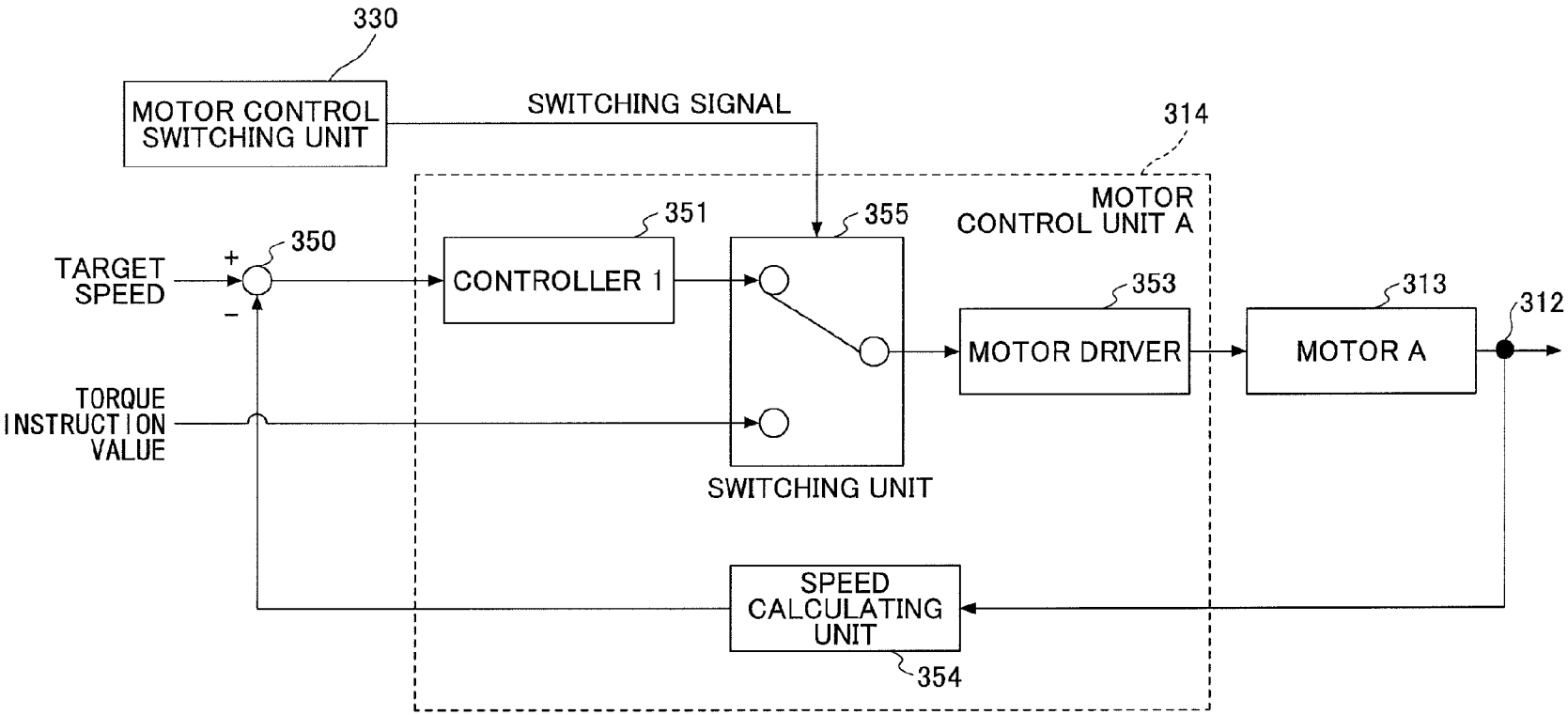
FIG. 13 is a control block diagram of the motor A of the sheet conveying device according to a modification the first embodiment.

FIG. 13 is a control block diagram of the motor A of the sheet conveying device 300 according to a modification the first embodiment. In FIG. 13, elements corresponding to those of FIG. 9 are denoted by the same reference numerals, and are not further described. The motor driver 353 in FIG. 13 is constituted by a current control driver.

The controller 1 is the same as the controller 1 of the first embodiment and modification 1. In the motor control unit A, at the time point when the sheet S enters the conveying roller B, the implementation of control is switched from the controller 1 to torque instruction values, by switching signals from the motor control switching unit 330. Furthermore, at the time point when the trailing edge of the sheet S passes through the conveying roller A, the implementation of control is switched from torque instruction values to the controller 1.

In a state where the sheet S is laid across the conveying roller A and the conveying roller B, at the motor control unit A, the torque instruction value is converted into a current value, which is used as the current instruction value for the motor driver 353. The motor driver 353 supplies a current in accordance with the current instruction value to the motor A. Accordingly, the motor A is driven by a current value in accordance with the torque instruction value, and a predetermined torque is generated.

The torque instruction value is set to prevent situations where the conveying roller A pushes the conveying roller B via the sheet S and a negative torque is generated at the motor B of the conveying roller B or the torque instruction value enters the non-linear area of the motor driver of the motor B.

When the sheet S is conveyed by the conveying roller A and the conveying roller B, the torque instruction value is a smaller value than the load torque generated at the motor B. Accordingly, the conveying roller A can assist conveying the sheet S without a load being applied on the conveying roller B by the conveying roller A. Furthermore, a tension, which corresponds to the torque difference between the load torque of the motor B and the torque instruction value of the motor A, is applied to the sheet S.

The load torque of the motor B changes according to the linear speed (conveying speed) and the type of sheet S, and therefore at the sheet conveying device 300, torque instruction values associated with linear speeds and sheet S types are stored in a ROM in advance. By storing a table of torque instruction values in a ROM and an HDD, the motor control unit A can select and read a torque instruction value according to the linear speed and the sheet S type.

Furthermore, the motor control unit A may adjust the torque instruction value, instead of fixing the torque instruction value. The motor control unit A of the conveying roller A measures the load current and the load torque of the conveying roller B on the downstream side, and determines the torque instruction value generated by the conveying roller A on the upstream side to correspond to the measured values. At the motor control unit A, for example, the torque instruction value is adjusted to be a slightly lower value (for example, approximately 90% through 99%) than the load torque corresponding to the load current of the conveying roller B.

Furthermore, instead of having the motor control unit A directly measure the load current and the load torque of the conveying roller B, an observer may be provided to estimate the load current and the load torque of the conveying roller B. The observer is a state estimator for estimating a state x from an output g and an input f, when the state x cannot be directly observed. In the case of estimating the load current and the load torque, a bandwidth limiting unit such as a low-pass filter is preferably provided after the output of the observer and before the input of the motor control unit A. By providing a bandwidth limiting unit such as a low-pass filter, the robustness with respect to disturbances such as noise can be increased.

As described above, by inputting a predetermined torque instruction value, it is possible to realize subordinate control by which the conveying roller A is subordinately rotated by the sheet S conveyed by the conveying roller B.

Modification 3

Figure 14:
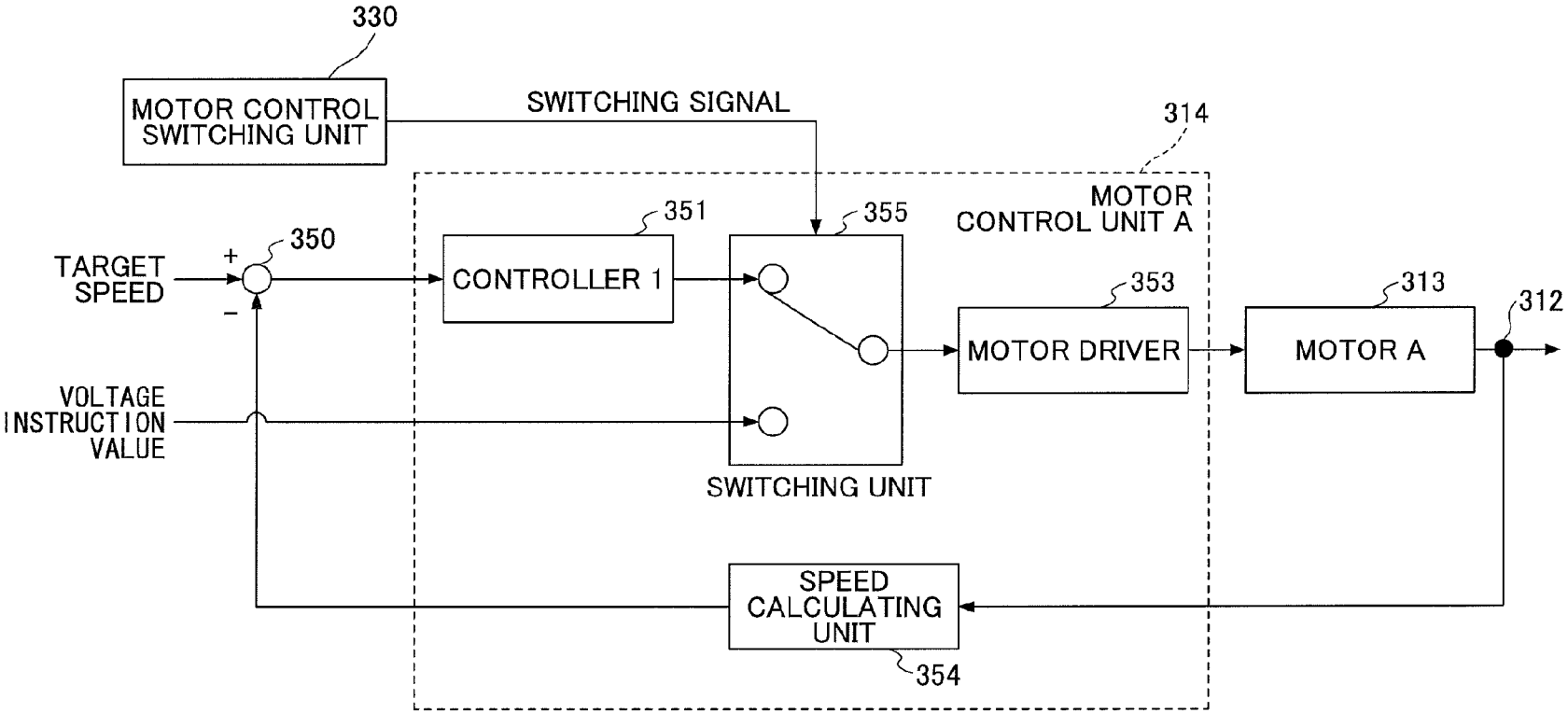
FIG. 14 is a control block diagram of the motor A of the sheet conveying device according to a modification the first embodiment.

FIG. 14 is a control block diagram of the motor A of the sheet conveying device 300 according to a modification the first embodiment. In FIG. 14, elements corresponding to those of FIG. 9 are denoted by the same reference numerals, and are not further described. The motor driver 353 in FIG. 14 is constituted by a voltage control driver.

A current control driver has a control loop of current detection and feedback. Therefore, a current detection sensor and a computing unit are necessary, which may lead to increased cost and the control logic may become complex. However, by constituting the motor driver 353 with a voltage control driver, there is no need for a sensor, and the subordinate control of the conveying roller A can be realized by a simple control logic.

The controller 1 is the same as the controller 1 of the first embodiment, modification 1, and modification 2. In the motor control unit A, at the time point when the sheet S enters the conveying roller B, the implementation of control is switched from the controller 1 to voltage instruction values, by switching signals from the motor control switching unit 330. Furthermore, at the time point when the trailing edge of the sheet S passes through the conveying roller A, the implementation of control is switched from voltage instruction values to the controller 1.

By constituting the motor driver 353 with a voltage control driver, the motor control unit A is driven by a voltage, and a torque according to the motor voltage and the motor rotation speed is generated. The voltage instruction value is set so that the load torque of the conveying roller A is lower than the load torque generated at the conveying roller B, when both the conveying roller A and the conveying roller B convey the sheet S.

By the above configuration, when the sheet S is conveyed by being laid across the conveying roller A and the conveying roller B, the conveying roller A acts as if it is subordinately rotated by the sheet S. At this time, a tension corresponding to the difference between the load torque of the conveying roller B and the load torque of the conveying roller A is applied to the sheet S.

Here, a description is given of the relationship between the voltage instruction value and the load torque of the conveying roller A. The motor torque T according to the voltage instruction value and the motor rotation speed is expressed by the following formula 4.

Formula 4

$$T = \frac{1}{sL + R} \times Kt \times (Volr - ke \cdot \omega) \tag{4}$$

T: motor torque
Volr: voltage instruction value (operation amount)
ω: angular velocity
Ke: inverse voltage constant
Kt: torque constant
L: motor winding inductance
R: motor winding resistance
s: Laplace operator (area)

To obtain the motor torque of the DC components, by setting zero as s in formula 4, the following formula is obtained.

Formula 5

$$T = \frac{1}{R} \times Kt \times (Volr - ke \cdot \omega) \tag{5}$$

By modifying formula 5 to a form of motor voltage with respect to the motor torque T, the following formula is obtained.

Formula 6

$$Volr = T \times \frac{R}{Kt} + ke \cdot \omega \tag{6}$$

By formula 6, the torque instruction value of FIG. 13 and the voltage instruction value of FIG. 14 can be handled equally.

The load torque of the motor B changes according to the linear speed (conveying speed) and the type of sheet S, and therefore at the motor control unit A, the voltage instruction values associated with linear speeds and sheet S types are stored in a ROM in advance. By creating a table of voltage instruction values and storing the table in a ROM and an HDD, the motor control unit A can select and read a voltage instruction value in a software manner according to the linear speed and the sheet S type.

Furthermore, the motor control unit A may adjust the voltage instruction value, instead of fixing the voltage instruction value. The motor control unit A of the conveying roller A measures the load current and the load torque of the conveying roller B on the downstream side, and determines the voltage instruction value applied to the conveying roller A on the upstream side to correspond to the measured values. At the motor control unit A, for example, the voltage instruction value is determined, by using formula 6, to be a slightly lower value (for example, approximately 90% through 99%) than the load torque corresponding to the load current of the conveying roller B or the load torque of the conveying roller B.

Furthermore, instead of having the motor control unit A directly measure the load current and the load torque of the conveying roller B, an observer may be provided to estimate the load current and the load torque of the conveying roller B. In the case of estimating the load current and the load torque, a bandwidth limiting unit such as a low-pass filter is preferably provided after the output of the observer and before the input of the motor control unit A. By providing a bandwidth limiting unit such as a low-pass filter, the robustness with respect to disturbances such as noise can be increased.

As described above, in the sheet conveying device 300 according to the present embodiment, the conveying roller is provided at the curved part of a conveying path of the sheet S, and when conveying the sheet S with the conveying roller A and the conveying roller B provided on the downstream side, the conveying roller A is controlled to be subordinately rotated by the sheet S, and the thickness of the sheet S can be detected from the rotation speed at which the conveying roller A is subordinately rotated.

Furthermore, in the image forming apparatus 100 including the sheet conveying device 300, the transfer condition and fixing condition can be appropriately set according to the thickness of the sheet S, and therefore image quality can be improved.

In the above-described embodiment, for example, the sheet conveying device 300 may be configured to realize the respective functions relevant to the present invention by executing programs provided in a ROM in advance. The programs executed by the sheet conveying device 300 have a module configuration including programs for realizing the respective units (the motor control switching unit 330, the rotation speed detecting unit 333, and the sheet thickness detecting unit 334). As the actual hardware, the CPU reads the programs from the ROM and executes the programs so that programs for realizing the above units (functional units) are loaded, so that the above units are realized. The CPU that functions as the above units may be installed in the sheet conveying device 300, or may be installed in the image forming apparatus 100 including the sheet conveying device 300.

The programs executed by the sheet conveying device 300 according to the first embodiment may be provided in a file of an installable format or an executable format recorded in a computer-readable recording medium such as a CD-ROM, a flexible disk (FD), a CD-R, and a DVD (Digital Versatile Disk).

Furthermore, the programs executed by the sheet conveying device 300 according to the first embodiment may be stored in a computer connected via a network such as the Internet, and may be provided by being downloaded via the network. Furthermore, the programs executed by the sheet conveying device 300 according to the first embodiment may be provided or distributed via a network such as the Internet.

Second Embodiment

A description is given of a second embodiment of the present invention with reference to drawings. The same configurations as those of the first embodiment are not further described.

Figure 15:
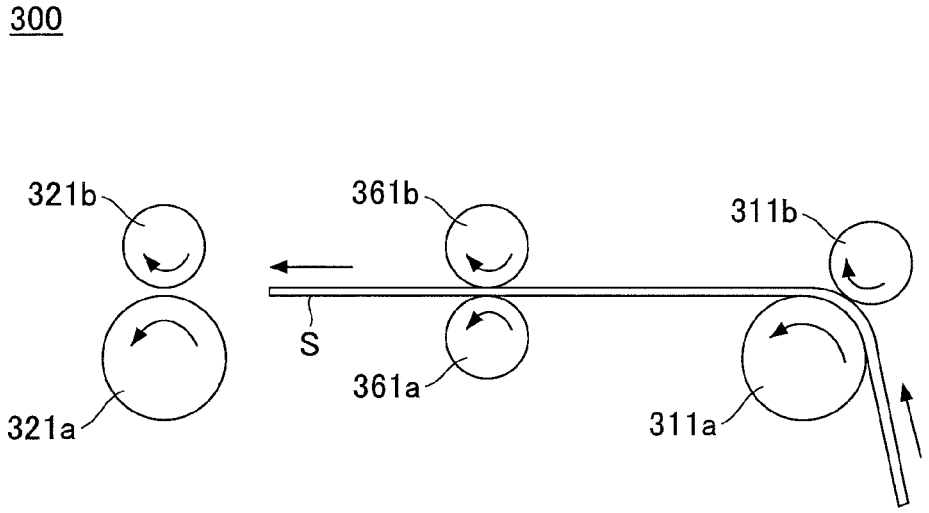
FIG. 15 illustrates a schematic configuration of relevant parts of the sheet conveying device according to a second embodiment.

FIG. 15 illustrates a schematic configuration of relevant parts of the sheet conveying device 300 according to the second embodiment.

As shown in FIG. 15, the sheet conveying device 300 according to the second embodiment includes the conveying rollers 311 provided at the curved part of the conveying path of the sheet S, conveying rollers 361, and the conveying rollers 321 that are provided on the downstream side of the conveying rollers 311 in the conveying path of the sheet S.

The conveying rollers 311 and 321 respectively include a pair of rollers facing each other. One of the rollers 311*a*, 321*a* in the roller pair is rotated by being connected to a motor acting as a driving unit, and the other one of the rollers 311*b*, 321*b* in the roller pair is subordinately rotated by the rollers 311*a*, 321*a*. Accordingly, the conveying rollers 311 and 321 sandwich the sheet S and convey the sheet S.

The conveying rollers 361 are an example of a rotating member provided as a conveying unit, and are rotatably provided between the conveying rollers 311 and the conveying rollers 321 in the conveying path of the sheet S. The two conveying rollers 361*a* and 361*b* of the conveying rollers 361 facing each other sandwich the sheet S that is conveyed by the conveying rollers 311 and/or the conveying rollers 321, and are also subordinately rotated by the sheet S. Furthermore, an encoder (not shown) is provided on the rotational shaft of either one of the conveying rollers 361*a* and 361*b*, and the rotation speed when the sheet S is conveyed is detected based on output from the encoder.

As shown in FIG. 15, the sheet S is laid across the conveying rollers 311 and the conveying rollers 361, and after being conveyed by both the conveying rollers 311 and the conveying rollers 361, the sheet S is conveyed to the conveying rollers 321 on the downstream side along the conveying path.

Figure 16:
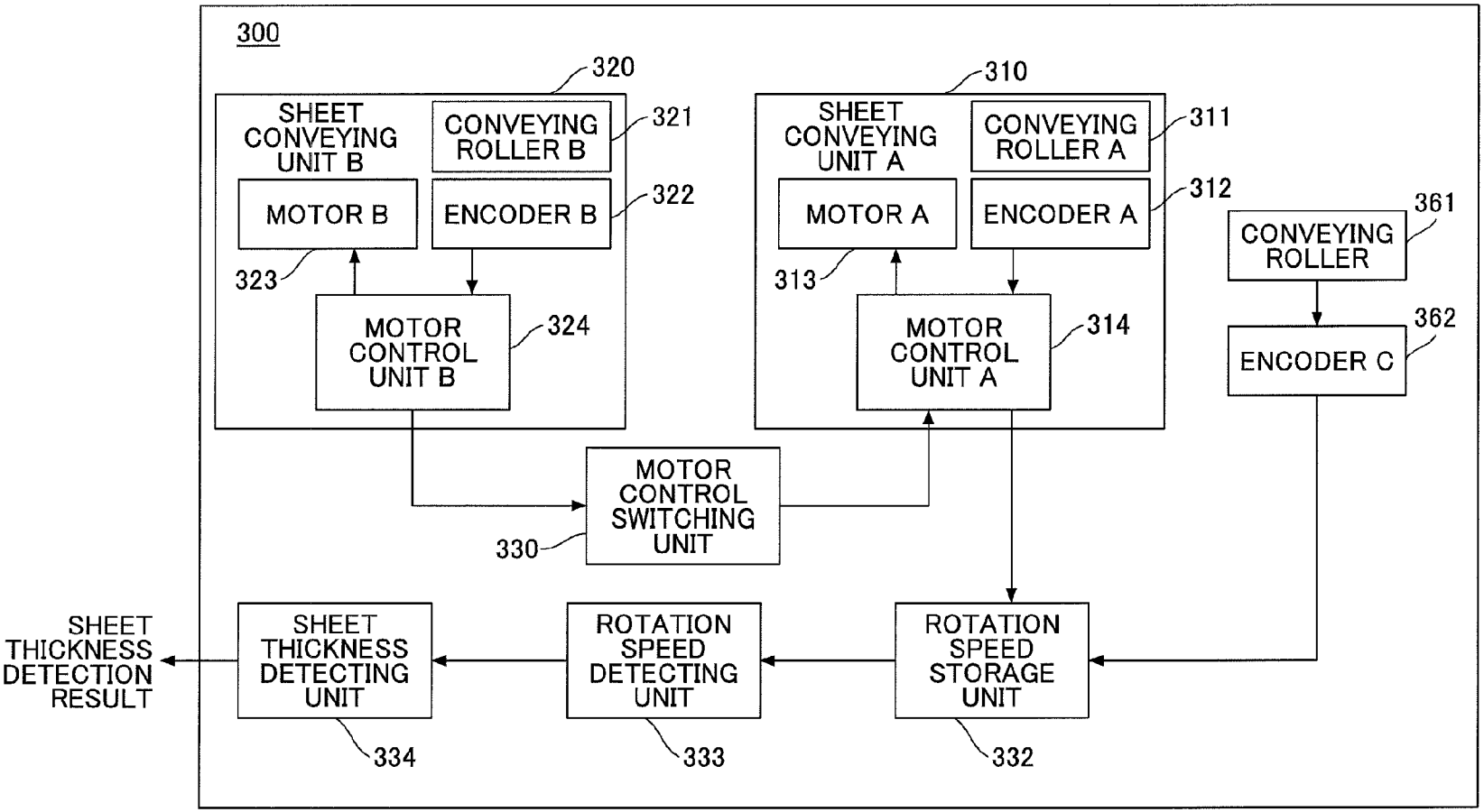
FIG. 16 is a functional block diagram of the sheet conveying device according to the second embodiment.

FIG. 16 is a functional block diagram of the sheet conveying device 300 according to the second embodiment.

The sheet conveying device 300 includes a sheet conveying unit 310 including the conveying rollers 311, the motor 313, the encoder 312, and the motor control unit 314, a sheet conveying unit 320 including the conveying rollers 321, the motor 323, the encoder 322, and the motor control unit 324, the conveying rollers 361, and an encoder 362 provided in the conveying rollers 361. Furthermore, the sheet conveying device 300 includes a motor control switching unit 330 for switching the control of the motor control unit 314, a rotation speed storage unit 332, a rotation speed detecting unit 333, and a sheet thickness detecting unit 334.

The motor control switching unit 330 sends, to the motor control unit 314, a signal for switching control so that the conveying rollers 311 are subordinately rotated, when the sheet S is passed from the conveying rollers 311 to the conveying rollers 321 on the downstream side. When the sheet S is passed from the conveying rollers 311 to the conveying rollers 321, instead of controlling the conveying rollers 311 to be subordinately rotated, the motor 313 may be continuously activated to rotate the conveying rollers 311.

The rotation speed storage unit 332 temporarily stores the rotation speed of the conveying rollers 311, 361 which is detected by the encoders 312, 362.

The rotation speed detecting unit 333 detects the rotation speed of the conveying roller 311*a* and the conveying speed of the sheet S, based on the rotation speed of a certain period of the conveying rollers 311*a*, 361 stored by the rotation speed storage unit 332.

The sheet thickness detecting unit 334 detects the thickness of the sheet S being conveyed based on the above formula 2, by using the rotation speed of the conveying roller 311*a* and the conveying speed of the sheet S detected by the rotation speed detecting unit 333.

Figure 17:
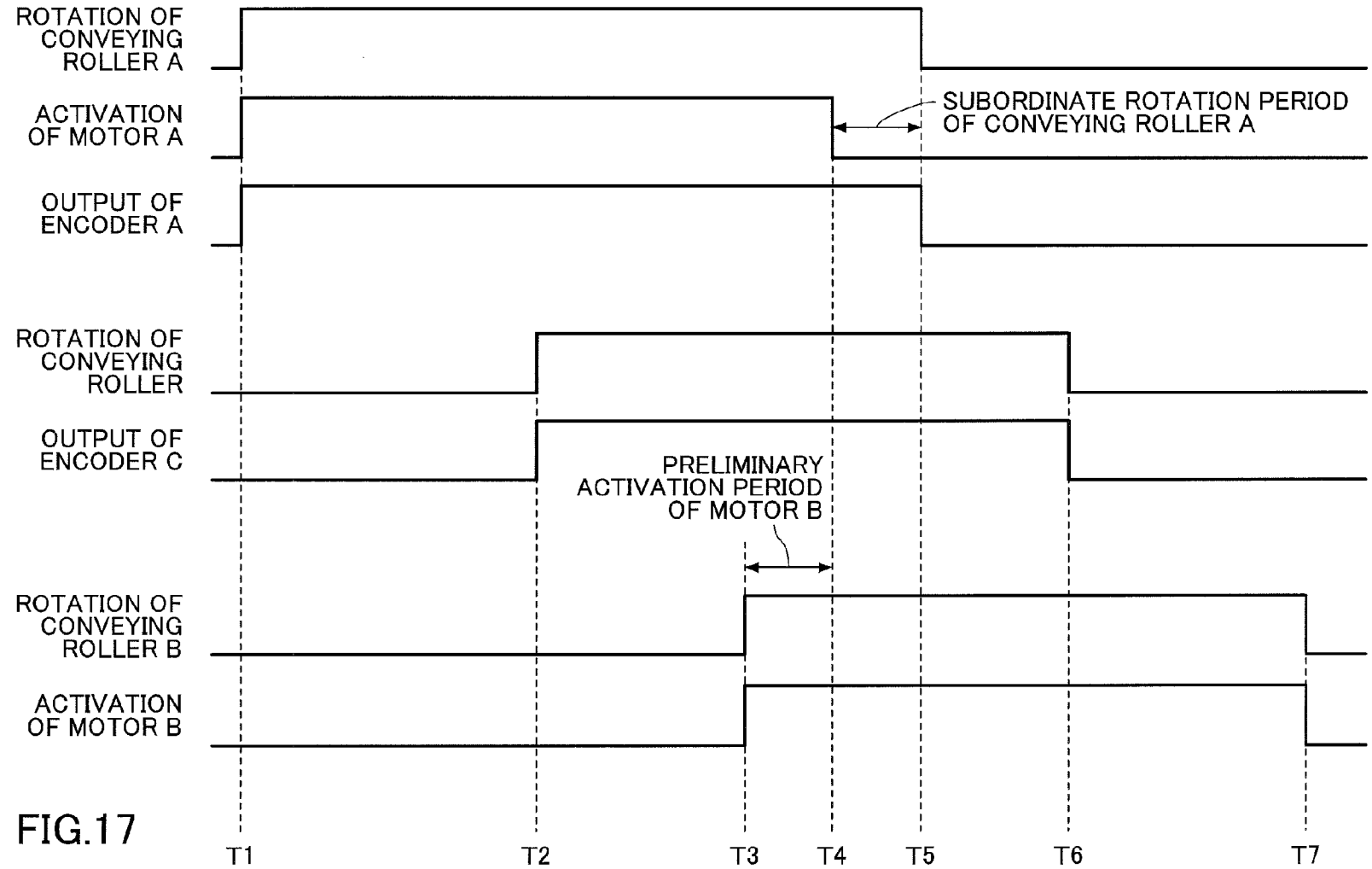
FIG. 17 is a timing chart of the sheet conveying device according to the second embodiment.

FIG. 17 is a timing chart of the sheet conveying device 300 according to the second embodiment.

First, at time T1, the motor 313 (hereinafter, "motor A") is activated, the conveying roller 311*a* (hereinafter, "conveying roller A") on the upstream side is rotated, and the sheet S starts to be conveyed. As the conveying roller A is rotated, the encoder 312 (hereinafter, "encoder A") starts to output detection results.

The sheet S is conveyed by the conveying rollers A, and at the time T2, the sheet S enters the conveying rollers 361 provided on the downstream side of the conveying rollers A. When the sheet S reaches the conveying rollers 361, the conveying rollers 361 are subordinately rotated by the sheet S, and the encoder 362 (hereinafter, "encoder C") provided on the conveying rollers 361 starts to output detection results.

At the time T3 before the sheet S reaches the conveying roller B, the motor 323 (hereinafter, "motor B") is activated, and the conveying rollers 321 (hereinafter, "conveying roller B") are rotated. The time period from the time T3 when the motor B starts to activate to the time T4 when the sheet S reaches the conveying roller B, is the preliminary activation period of the motor B. By providing this preliminary activation period, the sheet S can be smoothly passed and conveyed from the conveying roller A to the conveying roller B.

At time T4, when the leading edge of the sheet S reaches the conveying roller B, the motor control switching unit 330 stops the activation of the motor A. The conveying roller A is subordinately rotated by the sheet S until the time T5, when the trailing edge of the sheet S passes through the conveying roller A. Even after the sheet S reaches the conveying roller B, the motor A may be continuously activated.

The sheet S is continuously conveyed by the conveying roller B, and at time T6, the trailing edge of the sheet S passes through the conveying rollers 361. When the conveying rollers 361 stop rotation, the encoder C stops outputting detection results. When activation of the motor B stops and the conveying roller B stops rotating at time T7, the sheet S is passed to and conveyed by a conveying unit provided on a further downstream side.

The sheet thickness detecting unit 334 detects the thickness of the sheet S based on the conveying speed Vs of the sheet S obtained from the rotation speed of the conveying rollers 361 and the rotation speed of the conveying roller 311*a*, during the time period between the time T2 and the time T4 while the sheet S is being conveyed in a state where the sheet S is laid across the conveying rollers 311 and the conveying rollers 361.

During the time period between the time T2 and the time T4, the conveying rollers 361 are subordinately rotated by the sheet S, and therefore the conveying speed Vs of the sheet S can be obtained from the rotation speed of the conveying rollers 361 obtained based on output form the encoder C during this period. Furthermore, the rotation speed of the conveying roller 311*a* during the time period between the time T2 and the time T4 can be obtained from output from the encoder A. Therefore, the sheet thickness detecting unit 334 can obtain the thickness of the sheet S based on the above formula 2 from the conveying speed Vs of the sheet S and the rotation speed of the conveying roller 311*a* during the time period between the time T2 and the time T4.

As described above, in the sheet conveying device 300 according to the present embodiment, the conveying roller A is provided at the curved part of the conveying path of the sheet S, and the thickness of the sheet S can be detected based on the conveying speed Vs of the sheet S obtained from the rotation speed of the conveying rollers 361 and the rotation speed of the conveying roller A while the sheet S is conveyed by being laid across the conveying roller A and the conveying rollers 361.

Furthermore, in the image forming apparatus 100 including the sheet conveying device 300, the transfer condition and fixing condition can be appropriately set according to the thickness of the sheet S, and therefore stable images can be constantly output.

In the second embodiment, the conveying rollers 361 are provided on the downstream side of the conveying roller A; however, the conveying rollers 361 may be provided on the upstream side of the conveying roller A. In either configuration, the thickness of the sheet S can be detected based on the conveying speed Vs of the sheet S obtained from the rotation speed of the conveying rollers 361 and the rotation speed of the conveying roller A while the sheet S is conveyed by being laid across the conveying rollers A and the conveying rollers 361.

Third Embodiment

A description is given of a third embodiment of the present invention with reference to drawings. The same configurations as those of the above embodiments are not further described.

Figure 18:
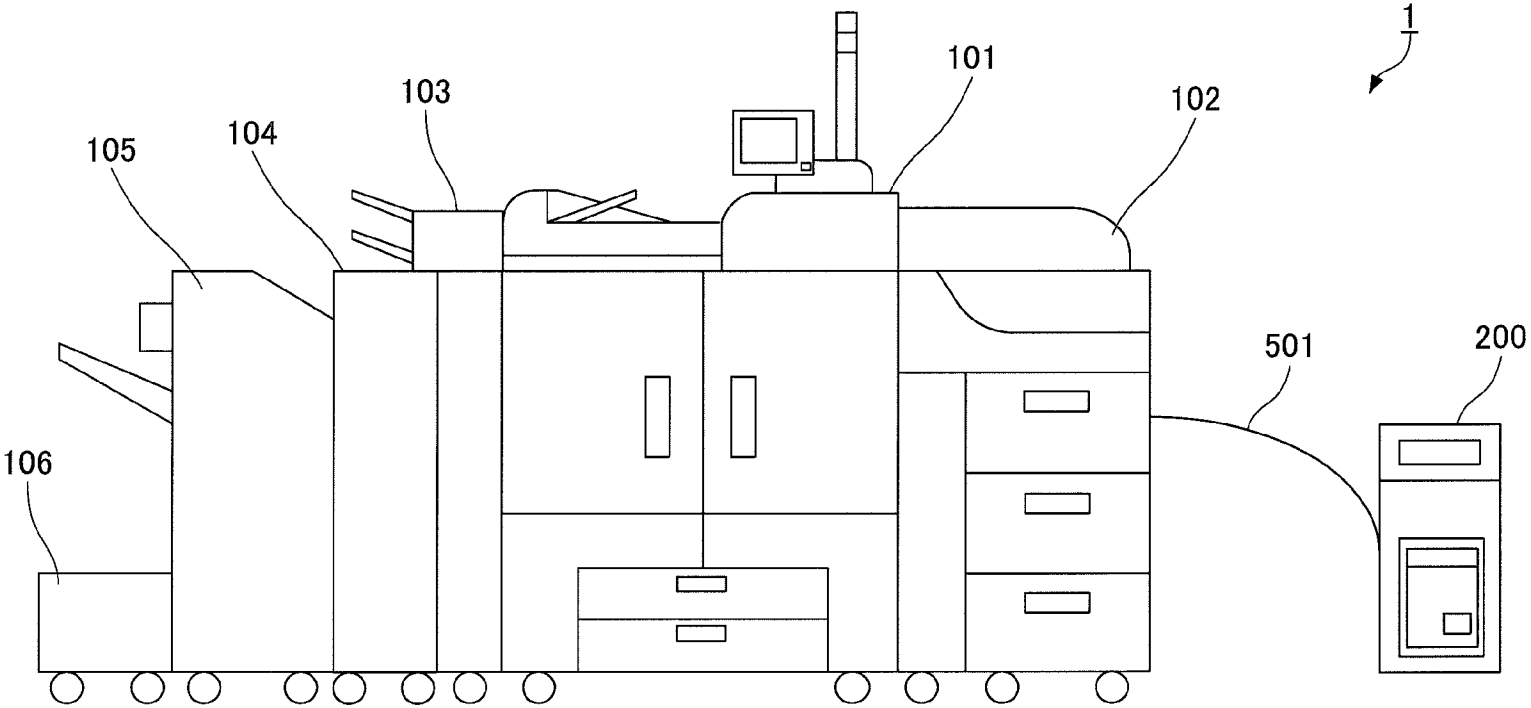
FIG. 18 is an external view of an image forming system according to a third embodiment.

FIG. 18 is an external view of an image forming system 1 according to a third embodiment.

The image forming system 1 according to the present embodiment is a so-called production printing system. Peripheral devices having functions of sheet feeding, folding, stapling, and cutting are combined with an image forming apparatus 101 and are used according to the purpose. In the present embodiment, a high volume sheet feeding unit 102, a server device 200, an inserter 103, a folding unit 104, a finisher 105 for stapling and hole-punching, and a cutter 106, are connected to the image forming apparatus 101.

The image forming apparatus 101 has the same configuration of the image forming apparatus 100 according to the first embodiment shown in FIG. 1, and includes a sheet conveying device 301 (see FIG. 19) having conveying rollers 30 for conveying the sheet S.

Figure 19:
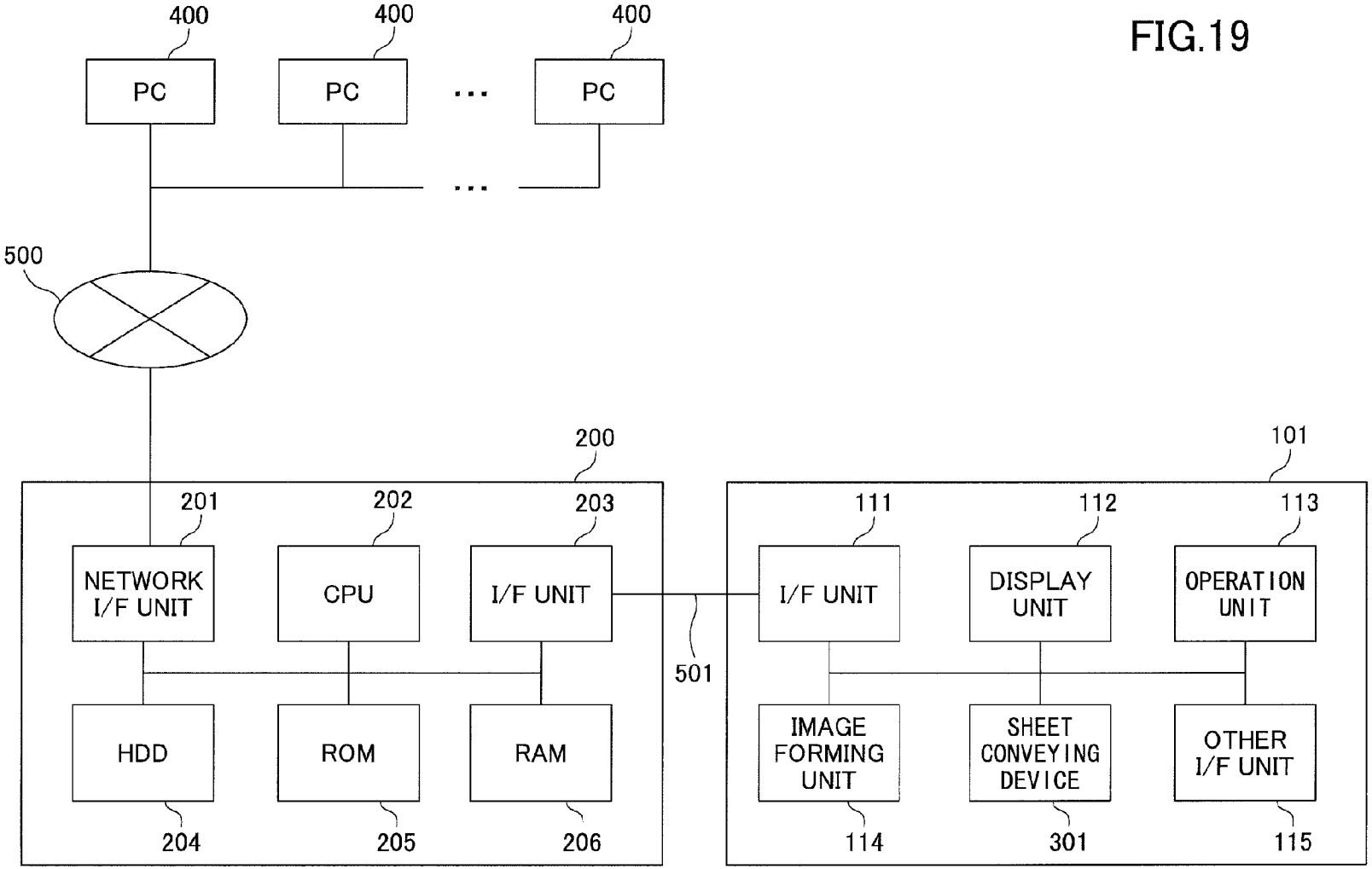
FIG. 19 illustrates a hardware configuration of an image forming apparatus and a server device according to the third embodiment.

FIG. 19 illustrates a hardware configuration of the image forming apparatus 101 and the server device 200.

The server device 200 includes a network I/F unit 201, a CPU 202, an I/F unit 203, a HDD 204, a ROM 205, and a RAM 206, which are interconnected by a bus. Furthermore, the server device 200 is connected to the image forming apparatus 101 via a dedicated line 501.

The CPU 202 performs control and calculation and processing on data in the computer, and executes programs stored in the ROM 205 and the RAM 206. The CPU 202 controls the overall device by executing programs.

The HDD 204 is a non-volatile storage device for storing various programs and data. Examples of the stored programs and data include an OS (Operating System) and applications for providing various functions.

The ROM 205 is a non-volatile semiconductor memory (storage device) that can hold internal data even after the power is turned off. Furthermore, the RAM 206 is a volatile semiconductor memory (storage device) for temporarily holding programs and data. The rotation speed of the conveying rollers A and the conveying rollers B is temporarily stored in the RAM 206.

The network I/F unit 201 is an interface between the server device 200 and a peripheral device such as PCs 400 having a communication function that is connected via a network such as LAN and WAN configured by a wired and/or wireless data transmission path.

The I/F unit 203 is a means for connecting to the image forming apparatus 101, and is connected to an I/F unit 111 of the image forming apparatus 101 by the dedicated line 501.

The image forming apparatus 101 connected to the server device 200 via the dedicated line 501 includes the I/F unit 111, a display unit 112, an operation unit 113, an image forming unit 114, a sheet conveying device 301, and another I/F unit 115.

The I/F unit 111 is a means for connecting to the server device 200, and is connected to the I/F unit 203 of the server device 200 by the dedicated line 501.

The display unit 112 and the operation unit 113 are constituted by a LCD (Liquid Crystal Display) including key switches (hard keys) and a touch panel function (including software keys of a GUI (Graphical User Interface)). The display unit 112 and the operation unit 113 are a display and/or input device functioning as a UI (User Interface) for using functions of the image forming apparatus 101.

The image forming unit 114 includes a photoconductor unit and a fixing device, and forms images based on image data on the surface of a sheet S.

The sheet conveying device 301 has the same configuration as the sheet conveying device 300 described in the first embodiment or the second embodiment.

In the image forming system 1 having such a configuration, as described in the above embodiments, the CPU 202 reads, from the ROM 205, programs having a module configuration for functioning as the control switch unit for switching the motor control unit A into subordinate control and the sheet thickness detecting unit for detecting the thickness of the sheet based on the rotation speed of the conveying roller A, and executes the programs, so that the server device 200 can function as a sheet thickness detecting device.

Accordingly, a sheet thickness detecting system is constituted by the sheet conveying device 301 included in the image forming apparatus 101 and the server device 200 functioning as a sheet thickness detecting device. The server device 200 detects the thickness of the sheet S conveyed by the sheet conveying device 301 and feeds back the detection result to the image forming unit 114 of the image forming apparatus 101. By the above configuration, printing can be performed with image forming conditions that are appropriate for the thickness of the sheet, and therefore the image quality output by the image forming system 1 can be improved.

It is preferable to have a configuration in which the image forming apparatus 101 including the sheet conveying device 301 and the server device 200 functioning as a sheet thickness detecting device are connected by the dedicated line 501, in terms of ensuring the speed of detecting the sheet thickness. Furthermore, if it is possible to ensure the speed of detecting the sheet thickness and feeding back the detection result to the image forming apparatus 101, the sheet thickness detecting device may be installed in a server device connected via a network, and may be decentrally installed in plural devices.

The programs executed by the server device 200 according to the third embodiment may be provided in a file of an installable format or an executable format recorded in a computer-readable recording medium such as a CD-ROM, a flexible disk (FD), a CD-R, and a DVD (Digital Versatile Disk).

Furthermore, the programs executed by the server device 200 according to the third embodiment may be stored in a computer connected via a network such as the Internet, and may be provided by being downloaded via the network. Furthermore, the programs executed by the server device 200 according to the third embodiment may be provided or distributed via a network such as the Internet.

According to one embodiment of the present invention, a sheet conveying device, an image forming apparatus, and a sheet thickness detection system, by which the thickness of a sheet can be detected with a simple configuration by using the sheet conveying mechanism.

The sheet conveying device, the image forming apparatus, and the sheet thickness detection system are not limited to the specific embodiments described herein, and variations and modifications may be made without departing from the scope of the present invention.

The present application is based on Japanese Priority Patent Application No. 2011-262967, filed on Nov. 30, 2011 and Japanese Priority Patent Application No. 2012-248644, filed on Nov. 12, 2012, the entire contents of which are hereby incorporated herein by reference.

What is claimed is:

1. A sheet conveying device comprising:

a conveying roller provided on an inner side of a curved part of a conveying path of a sheet;

a driving unit configured to rotate the conveying roller;

a drive control unit configured to control a rotation speed of the conveying roller by the driving unit, a rotation speed detecting unit configured to detect the rotation speed of the conveying roller;

a conveying unit, including a plurality of rollers downstream of the conveying roller in a sheet conveying direction, configured to convey the sheet laid across the conveying roller and the conveying unit;

a conveying speed detecting unit configured to detect a conveying speed of the sheet; and a sheet thickness detecting unit configured to detect a thickness of the sheet based on the conveying speed of the sheet detected by the conveying speed detecting unit, a radius of the conveying roller and the rotation speed of the conveying roller detected by the rotation speed detecting unit, wherein at least one of the conveying roller and the conveying unit is subordinately rotated by the sheet when the sheet is laid across the conveying roller and the conveying unit, wherein the conveying unit is a pair of rollers that sandwich and convey the sheet, wherein one of the rollers included in the pair of rollers is driven to rotate, and the conveying speed detecting unit obtains the conveying speed of the sheet by detecting a rotation speed of the one of the rollers included in the pair of rollers while the sheet is laid across conveying roller and the conveying unit.

2. The sheet conveying device according to claim claim 1, wherein the rotation speed detecting unit detects the rotation speed of the conveying roller by averaging the conveying speeds of the conveying roller while the conveying roller is subordinately rotated by the sheet more than once.

3. An image forming apparatus comprising the sheet conveying device according to claim 1.

4. The sheet conveying device according to claim 1, wherein the sheet thickness detecting unit is further configured to detect a thickness of the sheet at the curved part of a conveying path of the sheet.

5. The sheet conveying device according to claim 1, wherein the plurality of rollers in the conveying unit includes an idler roller.

6. A sheet conveying device comprising:

a conveying roller provided on an inner side of a curved part of a conveying path of a sheet;

a driving unit configured to rotate the conveying roller;

a drive control unit configured to control a rotation speed of the conveying roller by the driving unit;

a rotation speed detecting unit configured to detect the rotation speed of the conveying roller;

a conveying unit, including a plurality of rollers downstream of the conveying roller in a sheet conveying direction, configured to convey the sheet laid across the conveying roller and the conveying unit;

a conveying speed detecting unit configured to detect a conveying speed of the sheet;

a sheet thickness detecting unit configured to detect a thickness of the sheet based on the conveying speed of the sheet detected by the conveying speed detecting unit, a radius of the conveying roller and the rotation speed of the conveying roller detected by the rotation speed detecting unit, wherein at least one of the conveying roller and the conveying unit is subordinately rotated by the sheet when the sheet is laid across the conveying roller and the conveying unit; and a control switch unit configured to switch the drive control unit to apply subordinate control, so that the conveying roller is subordinately rotated by the sheet while the sheet is laid across the conveying roller and the conveying unit, wherein the rotation speed detecting unit detects the rotation speed of the conveying roller that is caused to be subordinately rotated by the sheet.

7. The sheet conveying device according to claim 6, wherein the drive control unit applies the subordinate control to the drive unit so that responsiveness of the conveying roller to speed variations is decreased in a part of or all of a frequency area of a control system.

8. The sheet conveying device according to claim 7, wherein the drive control unit applies the subordinate control to the drive unit so that the rotation speed of the conveying roller and a target speed have a constant deviation.

9. The sheet conveying device according to claim 6, wherein the drive control unit applies the subordinate control to the drive unit so that the rotation speed of the conveying roller is in accordance with a steady torque.

10. The sheet conveying device according to claim 6, wherein the drive control unit applies the subordinate control to the drive unit so that the rotation speed of the conveying roller is in accordance with a predetermined voltage.

11. A sheet thickness detecting system comprising a sheet conveying device including a conveying roller provided on an inner side of a curved part of a conveying path of a sheet, a driving unit configured to rotate the conveying roller, a drive control unit configured to control a rotation speed of the conveying roller by the driving unit, a rotation speed detecting unit configured to detect the rotation speed of the conveying roller, a conveying unit, including a plurality of rollers downstream of the conveying roller in a sheet conveying direction, configured to convey the sheet laid across the conveying roller and the conveying unit, and a conveying speed detecting unit configured to detect a conveying speed of the sheet, wherein the sheet thickness detecting system further comprises a sheet thickness detecting unit configured to detect a thickness of the sheet based on the conveying speed of the sheet detected by the conveying speed detecting unit, a radius of the conveying roller and the rotation speed of the conveying roller detected by the rotation speed detecting unit, wherein at least one of the conveying roller and the conveying unit is subordinately rotated by the sheet when the sheet is laid across the conveying roller and the conveying unit, wherein the conveying unit is a pair of rollers that sandwich and convey the sheet, wherein one of the rollers included in the pair of rollers is driven to rotate, and the conveying speed detecting unit obtains the conveying speed of the sheet by detecting a rotation speed of the one of the rollers included in the pair of rollers while the sheet is laid across conveying roller and the conveying unit.

12. The sheet thickness detecting system according to claim 11, wherein the sheet thickness detecting unit is further configured to detect a thickness of the sheet at the curved part of a conveying path of the sheet.

13. The sheet thickness detecting system according to claim 11, wherein the plurality of rollers in the conveying unit includes an idler roller.

* * * * *